US009595234B2

(12) United States Patent
Dai

(10) Patent No.: US 9,595,234 B2
(45) Date of Patent: Mar. 14, 2017

(54) SCAN DRIVING CIRCUIT HAVING PULL-UP CONTROL ASSEMBLY AND LCD DEVICE

(71) Applicant: SHENZHEN CHINA STAR OPTOELECTRONICS TECHNOLOGY CO., LTD, Shenzhen (CN)

(72) Inventor: Chao Dai, Shenzhen (CN)

(73) Assignee: SHENZEHN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 180 days.

(21) Appl. No.: 14/411,106

(22) PCT Filed: Jun. 25, 2014

(86) PCT No.: PCT/CN2014/080723
§ 371 (c)(1),
(2) Date: Dec. 24, 2014

(87) PCT Pub. No.: WO2015/176348
PCT Pub. Date: Nov. 26, 2015

(65) Prior Publication Data

US 2016/0284303 A1 Sep. 29, 2016

(30) Foreign Application Priority Data

May 20, 2014 (CN) ..... 2014 1 0213266

(51) Int. Cl.
*G09G 3/36* (2006.01)

(52) U.S. Cl.
CPC ..... *G09G 3/3677* (2013.01); *G09G 3/36* (2013.01); *G09G 2300/0408* (2013.01);
(Continued)

(58) Field of Classification Search
CPC ..... G09G 3/3677; G09G 2310/06; G09G 2310/08; G09G 2320/0214; G09G 2310/0286
See application file for complete search history.

(56) References Cited

U.S. PATENT DOCUMENTS 9,373,413 B2 * 6/2016 Wang ..... G11C 19/28
2014/0103983 A1 4/2014 Chang et al.

FOREIGN PATENT DOCUMENTS

CN 101853705 A 10/2010
CN 103310755 A * 9/2013 ..... G09G 3/20
(Continued)

OTHER PUBLICATIONS

Yin Huayu, the International Searching Authority written comments, Mar. 2015, CN.

*Primary Examiner* — Larry Sternbane

(57) ABSTRACT

A scan driving circuit includes a pull-up assembly, a pull-up control assembly that drives the pull-up assembly, a pull-down maintaining assembly, and a reference low-level signal. The reference low-level signal includes a first reference low-level signal and a second reference low-level signal. When the current scanning line is inactive, the pull-down maintaining assembly controls the reference low-level to be sent to the current scanning line and the output end of the pull-up control assembly according to a pull-down maintaining signal.

19 Claims, 9 Drawing Sheets

(52) U.S. Cl.
CPC ..... *G09G 2310/06* (2013.01); *G09G 2310/08* (2013.01); *G09G 2320/0214* (2013.01)

(56) References Cited

FOREIGN PATENT DOCUMENTS

| | | | | | |
|---|---|---|---|---|---|
| CN | 103680453 | A | | 3/2014 | |
| CN | 103745706 | A | | 4/2014 | |
| CN | 103928008 | A | | 7/2014 | |
| CN | 104008739 | A | | 8/2014 | |
| CN | 104008741 | A | | 8/2014 | |
| CN | WO 2015000187 | A1 | * | 1/2015 | ..... G09G 3/20 |
| EP | 2728583 | A1 | | 5/2014 | |

* cited by examiner

SCAN DRIVING CIRCUIT HAVING PULL-UP CONTROL ASSEMBLY AND LCD DEVICE

TECHNICAL FIELD

The present disclosure relates to the field of display devices, and more particularly to a scan driving circuit and a liquid crystal display (LCD) device.

BACKGROUND

A gate driver on array (GOA) circuit uses an array manufacturing method of a typical thin film transistor liquid crystal display device (TFT LCD) to make a scan driving circuit on an array substrate, which drives a gate scan line stage by stage.

When a voltage difference Vg between a control end and an output end of a pull-up control assembly of a typical GOA circuit is greater than zero, a pull-up assembly may turn on during an inactive stage of a current scanning line, and the current scanning line is driven, which causes current leakage of the GOA circuit, thereby affecting stability and reliability of the GOA circuit.

SUMMARY

The aim of the present disclosure is to provide a scan driving circuit and a liquid crystal display (LCD) device capable of reducing current leakage of the scan driving circuit.

The aim of the present disclosure is achieved by the following methods.

A scan driving circuit comprises a pull-up assembly, a pull-up control assembly that drives the pull-up assembly, a pull-down maintaining assembly, and a reference low-level signal comprising a first reference low-level signal and a second reference low-level signal. An output end of the pull-up assembly is coupled to a current scanning line, an output end of the pull-up control assembly is connected to a control end of the pull-up assembly, and the second reference low-level signal is sent to the output end of the pull-up control assembly through the pull-down maintaining assembly, the first reference low-level signal is sent to the current scanning line through the pull-down maintaining assembly, electric potential of the second reference low-level signal is lower than the electric potential of the first reference low-level signal.

When the current scanning line is inactive, the second reference low-level signal is sent to the output end of the pull-up control assembly trough the pull-down maintaining assembly, and the first reference low-level signal is also sent to the current scanning line through the pull-down maintaining assembly.

A clock scanning signal is sent to the input end of the pull-up assembly, a pull-up control signal is sent to the control end of the pull-up control assembly.

Furthermore, the pull-down maintaining assembly comprises a first pull-down maintaining assembly, a second pull-down maintaining assembly and a pull-down maintaining signal, input ends of the first pull-down maintaining assembly and the second pull-down maintaining assembly are coupled to the output end of the pull-up control assembly, the pull-down maintaining signal is sent to control ends of the first pull-down maintaining assembly and the second pull-down maintaining assembly, and the reference low-level signal is sent to output ends of the first pull-down maintaining assembly and the second pull-down maintaining assembly.

The scan driving circuit further comprises a diverter switch, the diverter switch is connected between the control end of first pull-down maintaining assembly and the control end of the second pull-down maintaining assembly, a control end of the diverter switch is coupled to the output end of the output end of the pull-up control assembly.

When the current scanning line is active, the second controllable switch turns off the first pull-down maintaining assembly and the second pull-down maintaining assembly, causing the reference low-level signal VSS not to be sent to the output end of the pull-up control assembly and the current scanning line. The first pull-down maintaining assembly and the second pull-down maintaining assembly alternately work, which avoids failure of the assembly because of long-term work of single assembly.

Furthermore, the pull-down maintaining assembly comprises a first pull-down maintaining assembly, the first pull-down maintaining assembly comprises a first pull-down maintaining unit and a first pull-down maintaining control unit that drives the first pull-down maintaining unit. The first pull-down maintaining unit comprises a first controllable switch and a second controllable switch, the pull-down maintaining signal comprises a first pull-down maintaining signal, where the first pull-down maintaining signal is sent to control ends of the first controllable switch and the second controllable switch through the first pull-down maintaining control unit. The second reference low-level signal is sent to the output end of the pull-up control assembly through the second controllable switch, and the first reference low-level signal is sent to the current scanning line through the first controllable switch. The electric potential of the pull-down maintaining signal, that is at a low level, is less than electric potential of the second reference low-level signal.

When the current scanning line G(N) is inactive, the first pull-down maintaining control unit controls the first controllable switch and the second controllable switch to turn on according to the first pull-down maintaining signal, the first controllable switch controls the second reference low-level signal to be sent to the output end of the pull-up control assembly, and the second controllable switch controls the first reference low-level signal to be sent to the current scanning line.

When the current scanning line is active, the first controllable switch and the second controllable switch turn off, the first controllable switch controls the second reference low-level signal not to be sent to the output end of the pull-up control assembly, and the second controllable switch controls the first reference low-level signal to be sent to the current scanning line.

Furthermore, the pull-down maintaining signal comprises a second pull-down maintaining signal, logical operation of the first pull-down maintaining signal is opposite to logical operation of the second pull-down maintaining signal, the first pull-down maintaining control unit comprises a third controllable switch, a fourth controllable switch, and a fifth controllable switch. The third controllable switch uses a diode connection method. In the diode connection method, the first pull-down maintaining signal is sent to an input end and a control end of the third controllable switch, an output end of the third controllable switch is coupled to a control end of the fourth controllable switch, and the first pull-down maintaining signal is sent to an input end of the fourth controllable switch. The second pull-down maintaining signal is sent to a control end of the fifth controllable switch, the first pull-down maintaining signal is sent to an input end of the fifth controllable switch, and output ends of the fourth controllable switch and the fifth controllable switch are coupled to the control ends of the first controllable switch and the second controllable switch.

When the current scanning line is inactive, the first controllable switch and the second controllable switch turn on according to the first pull-down maintaining signal and the second pull-down maintaining signal. The first reference low-level signal reduces electric potential of the current scanning line through the first controllable switch, and the second reference low-level signal reduces electric potential of the output end of the pull-up control assembly through the second controllable switch.

When the current scanning line is active, the first controllable switch and the second controllable switch turn off, the second reference low-level signal is not sent to the output end of the pull-up control assembly, and the first reference low-level signal is not sent to the current scanning line.

Furthermore, the pull-down maintaining assembly further comprises a turn-off unit, the turn-off unit comprises a sixth controllable switch, a control end of the sixth controllable switch is coupled to the output end of the pull-up control assembly, and an input end of the sixth controllable switch is coupled to the control end of the fourth controllable switch. The first reference low-level signal, the second reference low-level signal, or the second pull-down maintaining signal is sent to an output end of the sixth controllable switch. When the current scanning line is active, the sixth controllable switch assists to reduce the electric potential of the control end of the fourth controllable switch, which can reduce the electric potentials of the control ends of the first and second controllable switches. Thus, the first and second controllable switches turn off, and the influence on the GOA due to the pull-down maintaining assembly is avoided.

Furthermore, the pull-down maintaining assembly further comprises a second pull-down maintaining assembly. The second pull-down maintaining assembly comprises a second pull-down maintaining unit and a second pull-down maintaining control unit that drives the second pull-down maintaining unit. The pull-down maintaining signal further comprises a second pull-down maintaining signal, logical operation of the first pull-down maintaining signal is opposite to logical operation of the second pull-down maintaining signal. The second pull-down maintaining unit comprises an eighth controllable switch and a ninth controllable switch, the second pull-down maintaining signal is sent to control ends of the eighth controllable switch and the ninth controllable switch through the second pull-down maintaining control unit. The first reference low-level signal is sent to the current scanning line through the eighth controllable switch, and the second reference low-level signal is sent to an output end of the pull-up control assembly through the ninth controllable switch.

when the current scanning line is inactive, the eighth controllable switch and the ninth controllable switch turn on according to the first pull-down maintaining signal and the second pull-down maintaining signal, the eighth controllable switch controls the first reference low-level signal to be sent to the current scanning line, and the ninth controllable switch controls the second reference low-level signal to be sent to the output end of the pull-up control assembly.

when the current scanning line is active, the eighth controllable switch and the ninth controllable switch turn off, the eighth controllable switch controls the first reference low-level signal not to be sent to the current scanning line, and the ninth controllable switch controls the second reference low-level signal not to be sent to the output end of the pull-up control assembly. The pull-down maintaining assembly is divided into two assemblies, where two pull-down maintaining assemblies alternately work, thus allowing one of the two pull-down maintaining assemblies to be at the inactive status for a half work time, thus, it avoids change of the electric potentials of the TFT at turn-on statuses and turn-off statuses because of long-time work of single pull-down maintaining assembly. This further avoids influence on turn-on of the pull-down maintaining assembly because of the change of the electric potentials of the TFT at turn-on status, and influence on turn-off of the pull-down maintaining assembly because of the change of the electric potentials of the TFT at turn-off status, thereby improving stability of the circuit of the GOA.

Furthermore, the second pull-down maintaining control unit comprises a tenth controllable switch, an eleventh controllable switch, and a twelfth controllable switch. The tenth controllable switch uses a diode connection method. In the diode connection method, the second pull-down maintaining signal is sent to an input end and a control end of the tenth controllable switch, an output end of the tenth controllable switch is coupled to a control end of the eleventh controllable switch, and the second pull-down maintaining signal is sent to an input end of the eleventh controllable switch. The first pull-down maintaining signal is sent to a control end of the twelfth controllable switch, the second pull-down maintaining signal is sent to an input end of the twelfth controllable switch, and output ends of the eleventh controllable switch and the twelfth controllable switch are coupled to the control ends of the eighth controllable switch and the ninth controllable switch.

When the current scanning line is inactive, the eighth controllable switch and the ninth controllable switch to turn on according to the first pull-down maintaining signal and the second pull-down maintaining signal, the first reference low-level signal reduces electric potential of the current scanning line through the eighth controllable switch, and the second reference low-level signal reduces electric potential of the output end of the pull-up control assembly through the ninth controllable switch.

When the current scanning line is active, the eighth controllable switch, and the ninth controllable switch turn off, which makes the first reference low-level signal not to be sent to the current scanning line, and the second reference low-level signal not to be sent to the output end of the pull-up control assembly.

Furthermore, the second pull-down maintaining unit further comprises a turn-off unit, the turn-off unit further comprises a thirteenth controllable switch. A control end of the thirteenth controllable switch is coupled to the output end of the pull-up control assembly, an input end of the thirteenth controllable switch is coupled to the control end of the eleventh controllable switch, and the first reference low-level signal or the second reference low-level signal is sent to an output end of the thirteenth controllable switch. When the current scanning line is active, the thirteenth controllable switch assists to reduce the electric potential of the control end of the eleventh controllable switch, which can reduce the electric potentials of the control ends of the eighth and ninth controllable switches. Thus, the eighth and ninth controllable switches turn off, and the influence on the GOA due to the pull-down maintaining assembly is avoided.

Furthermore, the pull-down maintaining assembly further comprises a diverter switch, a control end of the diverter switch is coupled to the output end of the pull-up control assembly, the diverter switch is arranged between the control ends of the first controllable switch and the second controllable switch and the control ends of the eighth controllable switch and the ninth controllable switch.

When the current scanning line is active, the diverter switch turns on and controls the control end of the first pull-down maintaining unit to be connected to the control end of the second pull-down maintaining unit. Electric potential of one of the control ends of the first pull-down maintaining unit and the second pull-down maintaining unit, that is at high level, is reduced by electric potential of another control end that is at low level, which turns off the first pull-down maintaining unit and the second pull-down maintaining unit. The diverter switch is used to balance the electric potentials of two ends thereof. Under the condition that the sixth controllable switch is out of work, when the diverter switch is on, the electric potential of point P(N) is reduced to the electric potential of point K(N) through the diverter switch, which turns off the first, second, eighth, and ninth controllable switches. Thus, influence on the signals of the current scanning line and the control end of the pull-up control assembly, that is caused because the TFTs do not turn off together, is avoided, and influence on the GOA circuit is further avoided.

Furthermore, the pull-up control assembly comprises a seventeenth controllable switch. An output end of the seventeenth controllable switch is coupled to the control end of the pull-up assembly, a pull-up control signal is sent to a control end and an input end of the seventeenth controllable switch. The pull-up assembly comprises an eighteenth controllable switch, a control end of the eighteenth controllable switch is coupled to the output end of the seventeenth controllable switch, the clock scanning signal is sent to an input end of the eighteenth controllable switch, and an output end of the eighteenth controllable switch is coupled to the current scanning line. The scan driving circuit further comprises a storage capacitor, a first end of the storage capacitor is coupled to the output end of the pull-up control assembly, and a second end of the storage capacitor is coupled to the output end of the pull-up assembly.

A liquid crystal display (LCD) device comprises any one of the above-mentioned scan driving circuit.

It should be understood that in a typical gate driver on array (GOA) circuit, because parasitic capacitance affects the GOA circuit, the control end of the pull-up assembly and the output end of the pull-up control assembly exhibit signal fluctuation. Thus, even if the current scan line is inactive, the GOA circuit still may drives the current scan line because of residual charge of the control end of the pull-up assembly, which makes voltage difference Vg between the control end and the output end of the pull-up assembly be greater than zero, and further drives the current scanning line, thereby affecting output of the GOA circuit and a driving display of the GOA circuit. The present disclosure uses the second reference low-level signal VSS2, where the electric potential of the first reference low-level signal is greater than the electric potential of the second reference low-level signal, thus, a voltage difference Vg between the control end and the output end of the pull-up assembly is less than zero, namely the pull-up assembly is at a negative turn-off status, which avoids current leakage, and improves the output of the GOA circuit and the driving display of the GOA circuit. Two negative pressure sources are employed in the present disclosure and share a load, which avoids fluctuation of generated electric potential because of an excessive load of a single negative pressure source, and further affecting the output of the GOA circuit.

DETAILED DESCRIPTION

The present disclosure will further be described in detail in accordance with the figures and the exemplary examples.

Figure 1:
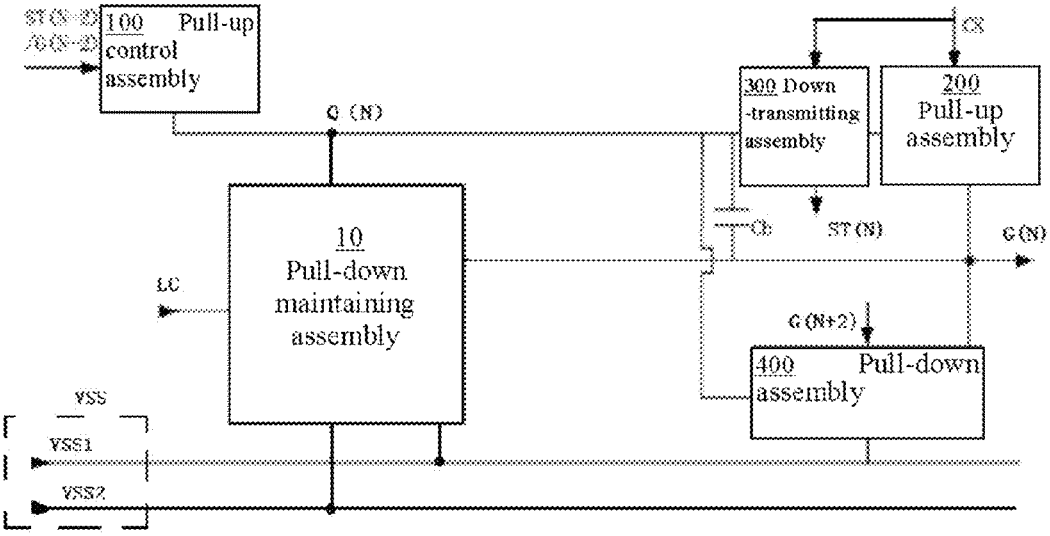
FIG. 1 is a schematic diagram of a scan driving circuit of the present disclosure.

FIG. 1 is a schematic diagram of a scan driving circuit, where the scan driving circuit comprises a pull-up assembly 200, a pull-up control assembly 100 that drives the pull-up assembly 200, a pull-down maintaining assembly 10, and a reference low-level signal VSS (logic 0). An output end of the pull-up assembly 200 is coupled to a current scanning line G(N), and a clock scanning signal CK is sent to an input end of the pull-up assembly 200. The reference low-level signal VSS comprises a first reference low-level signal VSS1 and a second reference low-level signal VSS2. An output end Q(N) of the pull-up control assembly 100 is coupled to a control end of the pull-up assembly 200, and the second reference low-level signal VSS2 is sent to the output end Q(N) of the pull-up control assembly 100 through the pull-down maintaining assembly 10. A pull-up control signal ST(N−2)/G(N−2) is sent to a control end of the pull-up control assembly 100, and the pull-up control signal ST(N−2)/G(N−2) comprises a previous scanning line G(N−2) and a previous down-transmitting signal ST(N−2). The first reference low-level signal VSS1 is sent to the current scanning line G(N) through the pull-down maintaining assembly 10, where an input end of the pull-down maintaining assembly 10 is coupled to the output end Q(N) of the pull-up control assembly 100, and the first reference low-level signal VSS1 and the second reference low-level signal VSS2 are sent to an output end of the pull-down maintaining assembly 10. Electric potential of the first reference low-level signal VSS1 is greater than electric potential of the second reference low-level signal VSS2.

When the current scanning line G(N) is inactive, the pull-down maintaining assembly 10 controls the second reference low-level signal VSS2 to be sent to the output end Q(N) of the pull-up control assembly 100, namely the second reference low-level signal VSS2 is sent to the control end of the pull-up assembly 200 and the pull-down maintaining assembly 10 also controls the first reference low-level signal VSS1 to be sent to the current scanning line G(N).

A pull-down maintaining signal LC is sent to the control end of the pull-down maintaining assembly 10, where the pull-down maintaining signal LC is a periodic signal generated by a time control circuit or other circuits. When the pull-down maintaining signal LC is at a low level (logic 0), voltage of the pull-down maintaining signal LC is less than voltage of the reference low-level signal VSS.

The scan driving circuit further comprises a pull-down assembly 400, where an input end of the pull-down assembly 400 is coupled to the current scan line G(N) and the output end Q(N) of the pull-up control assembly 100, a control end of the pull-down assembly 400 is coupled to a next scanning line G(N+2), and the reference low-level signal VSS is sent to an output end of the pull-down assembly 400.

The scan driving circuit further comprises a storage capacitor Cb, where a first end of the storage capacitor Cb is coupled to the output end Q(N) of the pull-up control assembly 100, and a second end of the storage capacitor Cb is coupled to the pull-down maintaining assembly 10 and the output end of the pull-up assembly 200.

It should be understood that in a typical gate driver on array (GOA) circuit, because parasitic capacitance affects the GOA circuit, the control end of the pull-up assembly exhibits signal fluctuation. Thus, even if the current scan line is inactive, the GOA circuit still may drive the current scan line because of residual charge of the control end of the pull-up assembly, which affects output of the GOA circuit and a driving display of the GOA circuit. The present disclosure uses the second reference low-level signal VSS2, where the electric potential of the first reference low-level signal VSS1 is greater than the electric potential of the second reference low-level signal VSS2, thus, a voltage difference Vg between the control end and the output end of the pull-up assembly is less than zero, namely the pull-up assembly is at a negative turn-off status, which improves the output of the GOA circuit and the driving display of the GOA circuit. Two negative pressure sources are employed in the present disclosure and share a load, which avoids fluctuation of generated electric potential because of an excessive load of a single negative pressure source, and further affecting the output of the GOA circuit.

Example 1

Figure 2:
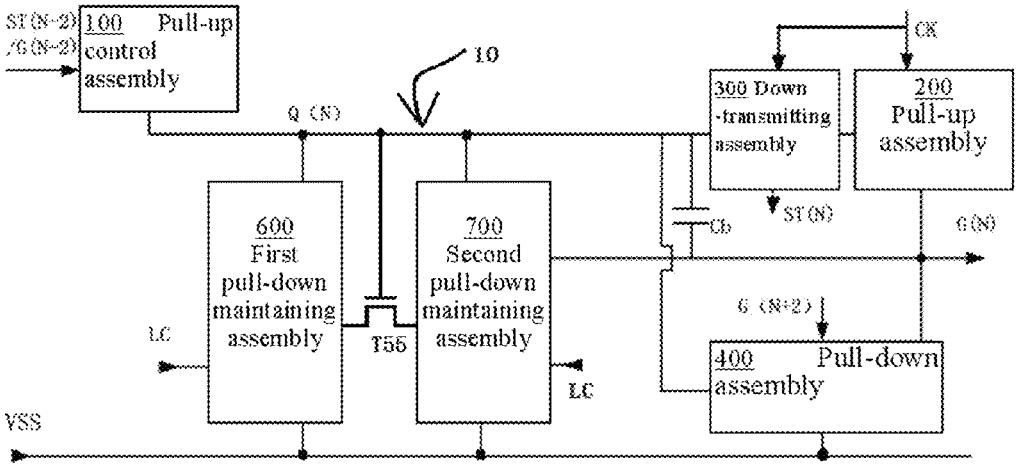
FIG. 2 is a schematic diagram of a first example of the scan driving circuit of the present disclosure.

FIG. 2 is a schematic diagram of a first example of the present disclosure. Combined with FIG. 1, the pull-down maintaining assembly 10 comprises a first pull-down maintaining assembly 600 and a second pull-down maintaining assembly 700. The scan driving scan further comprises the pull-down maintaining signal LC, where input ends of the first pull-down maintaining assembly 600 and the second pull-down maintaining assembly 700 are coupled to the output end Q(N) of the pull-up control assembly 100, the pull-down maintaining signal LC is sent to control ends of the first pull-down maintaining assembly 600 and the second pull-down maintaining assembly 700, and the reference low-level signal VSS is sent to output ends of the first pull-down maintaining assembly 600 and the second pull-down maintaining assembly 700.

The scan driving circuit further comprises a diverter switch T55, where the diverter switch T55 is connected between the control end of first pull-down maintaining assembly 600 and the control end of the second pull-down maintaining assembly 700, and a control end of the diverter switch T55 is coupled to the output end Q(N) of the pull-up control assembly 100.

When the current scanning line G(N) is active, the diverter switch T55 controls the first pull-down maintaining assembly 600 and the second pull-down maintaining assembly 700 to turn off, thus, the reference low-level signal VSS is not sent to the output end Q(N) of the pull-up control assembly 100 and the current scanning line G(N).

When the current scanning line G(N) is active, the diverter switch T55 is used to turn off the first pull-down maintaining assembly 600 and the second pull-down maintaining assembly 700, which prevents the first pull-down maintaining assembly 600 and the second pull-down maintaining assembly 700 from working when the current scanning line G(N) is active. That makes the voltage of the output end Q(N) of the pull-up control assembly 100 not to increase, to cause failure of the GOA circuit. When the current scanning line G(N) is inactive, one of the first pull-down maintaining assembly 600 and the second pull-down maintaining assembly 700 discharges remnant current of the output end Q(N) of the pull-up control assembly 100 to reduce current leakage of the GOA circuit. The first pull-down maintaining assembly 600 and the second pull-down maintaining assembly 700 switch alternately work, which avoids failure of the pull-down maintaining assembly because of long-term work of a single pull-down maintaining assembly.

Example 2

Figure 3:
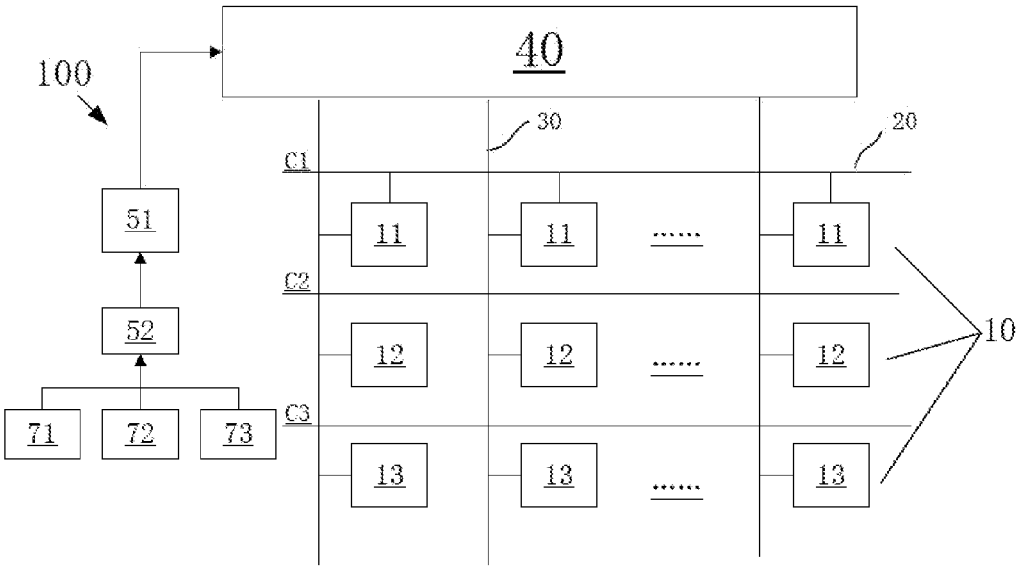
FIG. 3 is a schematic diagram of a second example of the scan driving circuit of the present disclosure.

FIG. 3 is a schematic diagram of a second example of the present disclosure, and FIG. 3 is an expanded view of the FIG. 1. The reference low-level signal VSS comprises the first reference low-level signal VSS1 and the second reference low-level signal VSS2, where the electric potential of the second reference low-level signal VSS2 is less than the electric potential of the first reference low-level signal VSS1 and greater than the electric potential of the pull-down maintaining signal LC. The pull-down maintaining assembly 10 comprises the first pull-down maintaining assembly 600, where the first pull-down maintaining assembly 600 comprises a first pull-down maintaining unit 610 and a first pull-down maintaining control unit 620 that drives the first pull-down maintaining unit 610. The first pull-down maintaining unit 610 comprises a first controllable switch T32 and a second controllable switch T42. The pull-down maintaining signal LC comprises a first pull-down maintaining signal LC1, where the first pull-down maintaining signal LC1 is sent to control ends of the first controllable switch T32 and the second controllable switch T42 through the first pull-down maintaining control unit 620. The first reference low-level signal VSS1 is sent to the current scanning line G(N) through the first controllable switch T32, and the second reference low-level signal VSS2 is sent to the output end Q(N) of the pull-up control assembly 100 through the second controllable switch T42.

When the current scanning line G(N) is inactive, the first pull-down maintaining control unit 620 controls the first controllable switch T32 and the second controllable switch T42 to turn on according to the first pull-down maintaining signal LC1. The first controllable switch T32 controls the first reference low-level signal VSS1 to be sent to the current scanning line G(N), and the second controllable switch T42 controls the second reference low-level signal VSS2 to be sent to the output end Q(N) of the pull-up control assembly 100 and the control end of the pull-up assembly 200.

When the current scanning line G(N) is active, the first controllable switch T32 and the second controllable switch T42 turn off. The first controllable switch T32 controls the first reference low-level signal VSS1 not to be sent to the current scanning line G(N), and the second controllable switch T42 controls the second reference low-level signal VSS2 not to be sent to the output end Q(N) of the pull-up control assembly 100.

The first pull-down maintaining control unit 620 comprises a third controllable switch T51, a fourth controllable switch T53, and a fifth controllable switch T54. The pull-down maintaining signal LC further comprises a second pull-down maintaining signal LC2, where logical operation of the first pull-down maintaining signal LC1 is opposite to logical operation of the second pull-down maintaining signal LC2. The third controllable switch T51 uses a diode connection method. In the diode connection method, the first pull-down maintaining signal LC1 is sent to an input end and a control end of the third controllable switch T51, and an output end of the third controllable switch T51 is coupled to a control end of the fourth controllable switch T53 or the control ends of the first controllable switch T32 and the second controllable switch T42. The second pull-down maintaining signal LC2 and the first pull-down maintaining signal LC1 are sent to an input end of the fourth controllable switch T53, and an output end of the fourth controllable switch T53 is coupled to the control ends of the first controllable switch T32 and the second controllable switch T42. The second pull-down maintaining signal LC2 is sent to a control end of the fifth controllable switch T54, the first pull-down maintaining signal LC1 is sent to an input end of the fifth controllable switch T54, and an output end of the fifth controllable switch T54 is coupled to the control ends of the first controllable switch T32 and the second controllable switch T42.

When the current scanning line G(N) is inactive, the first controllable switch T32 and the second controllable switch T42 turn on according to the first pull-down maintaining signal LC1 and the second pull-down maintaining signal LC2. The first reference low-level signal VSS1 reduces electric potential of the current scanning line G(N) through the first controllable switch T32, and the second reference low-level signal VSS2 reduces electric potential of the output end Q(N) of the pull-up control assembly 100 through the second controllable switch T42.

When the current scanning line G(N) is active, the first controllable switch T32 and the second controllable switch T42 turn off, thus, the second reference low-level signal VSS2 is not sent to the output end Q(N) of the pull-up control assembly 100, and the first reference low-level signal VSS1 is not sent to the current scanning line G(N).

The pull-down maintaining assembly 10 comprises a turn-off unit 900, where the turn-off unit 900 comprises a sixth controllable switch T52. A control end of the sixth controllable switch T52 is coupled to the output end Q(N) of the pull-up control assembly 100, an input end of the sixth controllable switch T52 is coupled to the control end of the fourth controllable switch T53, and the second reference low-level signal VSS2 or the second pull-down maintaining signal LC2 is sent to an output end of the sixth controllable switch T52, it should be considered that the first reference low-level signal VSS1 can also be sent to the output end of the sixth controllable switch T52.

The pull-down maintaining assembly 10 further comprises a second pull-down maintaining assembly 700, where the second pull-down maintaining assembly 700 comprises a second pull-down maintaining unit 710 and a second pull-down maintaining control unit 720 that drives the second pull-down maintaining unit 710. The pull-down maintaining signal LC further comprises the second pull-down maintaining signal LC2, where logical operation of the first pull-down maintaining signal LC1 is opposite to logical operation of the second pull-down maintaining signal LC2. The second pull-down maintaining unit 710 comprises an eighth controllable switch T33 and a ninth controllable switch T43, where the second pull-down maintaining signal LC2 is sent to control ends of the eighth controllable switch T33 and the ninth controllable switch T43 through the second pull-down maintaining control unit 720. The first reference low-level signal VSS1 is sent to the current scanning line G(N) through the eighth controllable switch T33, and the second reference low-level signal VSS2 is sent to the output end Q(N) of the pull-up control assembly 100 through the ninth controllable switch T43.

When the current scanning line G(N) is inactive, the first pull-down maintaining unit 610 and the second pull-down maintaining unit 710 alternately turn on. When the second pull-down maintaining unit 710 turns on, the eighth controllable switch T33 and the ninth controllable switch T43 turn on, and the second reference low-level signal VSS2 is sent to the output end Q(N) of the pull-up control assembly 100 and the first reference low-level signal VSS1 is sent to the current scanning line G(N).

When the current scanning line G(N) is active, the first pull-down maintaining unit 610 and the second pull-down maintaining unit 710 turn off, and the first controllable switch T32, the second controllable switch T42, the eighth controllable switch T33, and the ninth controllable switch T43 turn off, which makes the second reference low-level signal VSS2 not to be sent to the output end Q(N) of the pull-up control assembly 100, and the first reference low-level signal VSS1 not to be sent to the current scanning line G(N). The pull-down maintaining assembly is divided into two assemblies, where two pull-down maintaining assemblies alternately work, thus allowing one of the two pull-down maintaining assemblies to be at an inactive status for a half work time, thus, it avoids change of the electric potentials of the TFT at turn-on statuses and turn-off statuses because of long-term work of single pull-down maintaining assembly. This further avoids influence on turn-on of the pull-down maintaining assembly because of the change of the electric potential of the TFT at turn-on status, and influence on turn-off of the pull-down maintaining assembly because of the change of the electric potential of the TFT at turn-off status, thereby improving stability of the circuit of the GOA.

The second pull-down maintaining control unit 720 comprises a tenth controllable switch T61, an eleventh controllable switch T63, and a twelfth controllable switch T64, where the tenth controllable switch T61 uses the diode connection method. In the diode connection method, the second pull-down maintaining signal LC2 is sent to an input end and a control end of the tenth controllable switch T61, and an output end of the tenth controllable switch T61 is coupled to a control end of the eleventh controllable switch T63. The second pull-down maintaining signal LC2 is sent to an input end of the eleventh controllable switch T63, and an output end of the eleventh controllable switch T63 is coupled to the control ends of the eighth controllable switch T33 and the ninth controllable switch T43. The first pull-down maintaining signal LC1 is sent to a control end of the twelfth controllable switch T64, the second pull-down maintaining signal LC2 is sent to an input end of the twelfth controllable switch T64, and an output end of the twelfth controllable switch T64 is coupled to the control ends of the eighth controllable switch T33 and the ninth controllable switch T43.

When the current scanning line G(N) is inactive, the second pull-down maintaining assembly 700 turns on, and the tenth controllable switch T61, the eleventh controllable switch T63, and the twelfth controllable switch T64 control the eighth controllable switch T33 and the ninth controllable switch T43 to turn on according to the first pull-down maintaining signal LC1 and the second pull-down maintaining signal LC2, which makes the first reference low-level signal VSS1 to be sent to the current scanning line G(N), and the second reference low-level signal VSS2 to be sent to the output end Q(N) of the pull-up control assembly 100.

The pull-down maintaining assembly 10 comprises a balance bridge unit 800, where the balance bridge unit 800 comprises the diverter switch T55, and the control end of the diverter switch T55 is coupled to the output end Q(N) of the pull-up control assembly 100. The diverter switch T55 is arranged between the control ends of the first controllable switch T32 and the second controllable switch T42 and the control ends of the eighth controllable switch T33 and the ninth controllable switch T43.

When the current scanning line G(N) is active, the diverter switch T55 turns on, thus, the first pull-down maintaining unit 610 is connected to the second pull-down maintaining unit 710, and electric potential of one of the control ends of the first pull-down maintaining unit 610 and the second pull-down maintaining unit 710, that is at high level, is reduced by electric potential of another control end that is at low level, thereby turning off the first pull-down maintaining unit 610 and the second pull-down maintaining unit 710. The diverter switch T55 is used to balance the electric potential of the first pull-down maintaining unit 610 and the second pull-down maintaining unit 710. Under the condition that the sixth controllable switch T52 is out of work, when the diverter switch T55 is on, the electric potential of point P(N) is reduced to the electric potential of point K (N) through the diverter switch T55, which turns off the first controllable switch T32 and the second controllable switch T42. Thus, influence on the signals of the G(N) and the Q(N), that is caused because the TFTs do not turn off together, is avoided, and influence on the GOA circuit is further avoided.

The turn-off unit 900 further comprises a thirteenth controllable switch T62, where a control end of the thirteenth controllable switch T62 is coupled to the output end Q(N) of the pull-up control assembly 100, an input end of the thirteenth controllable switch T62 is coupled to the control end of the eleventh controllable switch T63, and the second reference low-level signal VSS2 or the first reference low-level signal VSS1 is sent to an output end of the thirteenth controllable switch T62. When the current scanning line G(N) is active, the sixth controllable switch T52 and the thirteenth controllable switch T62 reduces electric potentials of point S(N) of the control end of the fourth controllable switch T53 and point T(N) of the control end of the eleventh controllable switch T63, which makes electric potential of point P(N) of the control ends of the first controllable switch T32 and the second controllable switch T42 and electric potential of point K(N) of the control ends of the eighth controllable switch T33 and the ninth controllable switch T43 to reduce, thereby turning off the pull-down maintaining assembly, and avoiding the pull-down maintaining assembly to affect the output of the GOA circuit. Because the electric potentials of the second reference low-level signal VSS2 and the first pull-down maintaining signal LC1, that are at low level, are less than the electric potential of the first reference low-level signal VSS1, voltage difference Vg between the control end and output end of the first controllable switch T32 is less than zero, voltage difference Vg between the control end and output end of the second controllable switch T42 is less than zero, voltage difference Vg between the control end and output end of the eighth controllable switch T33 is less than zero, and voltage difference Vg between the control end and output end of the ninth controllable switch T43 is less than zero; namely the first controllable switch T32, the second controllable switch T42, the eighth controllable switch T33, and the ninth controllable switch T43 are at turn-off status, which reduces the current leakage of the GOA circuit.

The electric potentials of the first pull-down maintaining signal LC1 and the second pull-down maintaining signal LC2 are not only less than the electric potential of the reference low-level signal VSS, but also the first pull-down maintaining signal LC1 and the second pull-down maintaining signal LC2 are low frequency signals. Switching time of the first pull-down maintaining signal LC1 and the second pull-down maintaining signal LC2 happens in a blanking time between each of the frames.

The pull-up control assembly 100 comprises a seventeenth controllable switch T11, where an output end of the seventeenth controllable switch T11 is coupled to the control end of the pull-up assembly 200. The pull-up control signal ST(N−2)/G(N−2) comprises the previous scanning line G(N−2) and the previous down-transmitting signal ST(N−2), where the previous down-transmitting signal ST(N−2) is sent to a control end of the seventeenth controllable switch T11, and an input end of the seventeenth controllable switch T11 is coupled to the previous scanning line G(N−2). The pull-up assembly 200 further comprises an eighteenth controllable switch T21, where a control end of the eighteenth controllable switch T21 is coupled to the output end Q(N) of the pull-up control assembly 100, the clock scanning signal CK is sent to an input end of the eighteenth controllable switch T21, and an output end of the eighteenth controllable switch T21 is coupled to the current scanning line G(N). The scan driving circuit further comprises the storage capacitor Cb, where the first end of the storage capacitor Cb is coupled to the output end Q(N) of the pull-up control assembly 100, and the second end of the storage capacitor Cb is coupled to the output end of the pull-up assembly 200.

The pull-down assembly 400 comprises a twentieth controllable switch T31 and a twenty-first controllable switch T41, where control ends of the twentieth controllable switch T31 and the twenty-first controllable switch T41 is coupled to the next scanning line G(N+2), an input end of the twentieth controllable switch T31 is coupled to the current scanning line G(N), and the reference low-level signal VSS is sent to an output end of the twentieth controllable switch T31. An input end of the twenty-first controllable switch T41 is coupled to the output end Q(N) of the pull-up control assembly 100, and the reference low-level signal VSS is sent to an output end of the twenty-first controllable switch T41.

The scan driving circuit further comprises a down-transmitting assembly 300, where a control end of the down-transmission 300 is coupled to the output end Q(N) of the pull-up control assembly 100 and the control end of the pull-up assembly 200, the clock scanning signal CK is sent to an input end of the down-transmitting assembly 300, and an output end of the down-transmitting assembly 300 outputs a current down-transmitting signal ST(N).

The down-transmitting assembly 300 comprises a nineteenth controllable switch T22, where a control end of the nineteenth controllable switch T22 is coupled to the output end Q(N) of the pull-up control assembly 100 and the control end of the pull-up assembly 200, the clock scanning signal CK is sent to an input end of the nineteenth controllable switch T22, and an output end of the nineteenth controllable switch T22 outputs a current down-transmitting signal ST(N). The current scanning line not only drives the next scanning line G(N+2) of circuit of next GOA, but also is regarded as a start signal of the circuit of next GOA. Thus, the start signal is not steady, thereby affecting the circuit of GOA, and further affecting display quality. In the present disclosure, the down-transmitting assembly is used, when the current scanning line drives the next scanning line, the down-transmitting assembly simultaneously generates a down-transmitting signal, and the down-transmitting signal is independent of the circuit of next GOA. Thus, steady working of the current scanning line is ensured, and even if the current scanning line G(N) is out of work, the next GOA is not affected, thereby enhancing stability of the GOA, and improving work of the GOA.

It should be considered that only one the pull-down maintaining assembly is arranged in the example, which also reduces the current leakage of the GOA circuit.

Example 3

Figure 4:
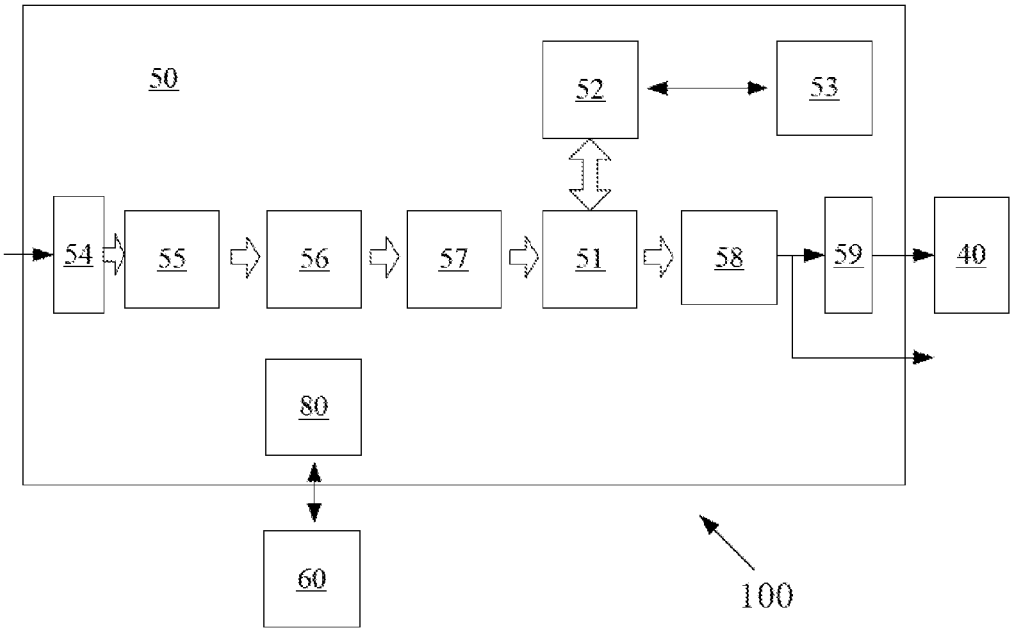
FIG. 4 is a schematic diagram of a third example of the scan driving circuit of the present disclosure.

FIG. 4 is a schematic diagram of a third example of the present disclosure, and FIG. 4 is an expanded view of the FIG. 1. The reference low-level signal VSS comprises the first reference low-level signal VSS1 and the second reference low-level signal VSS2, where the electric potential of the second reference low-level signal VSS2 is less than the electric potential of the first reference low-level signal VSS1 and greater than the electric potential of the pull-down maintaining signal LC. The pull-down maintaining assembly 10 comprises the first pull-down maintaining assembly 600, where the first pull-down maintaining assembly 600 comprises the first pull-down maintaining unit 610 and the first pull-down maintaining control unit 620 that drives the first pull-down maintaining unit 610. The first pull-down maintaining unit 610 comprises the first controllable switch T32 and the second controllable switch T42. The pull-down maintaining signal LC comprises the first pull-down maintaining signal LC1, where the first pull-down maintaining signal LC1 is sent to control ends of the first controllable switch T32 and the second controllable switch T42 through the first pull-down maintaining control unit 620. The first reference low-level signal VSS1 is sent to the current scanning line G(N) through the first controllable switch T32, and the second reference low-level signal VSS2 is sent to the output end Q(N) of the pull-up control assembly 100 through the second controllable switch T42.

When the current scanning line G(N) is inactive, the first pull-down maintaining control unit 620 controls the first controllable switch T32 and the second controllable switch T42 to turn on according to the first pull-down maintaining signal LC1. The first controllable switch T32 controls the first reference low-level signal VSS1 to be sent to the current scanning line G(N), and the second controllable switch T42 controls the second reference low-level signal VSS2 to be sent to the output end Q(N) of the pull-up control assembly 100.

When the current scanning line G(N) is active, the first controllable switch T32 and the second controllable switch T42 turn off. The first controllable switch T32 controls the first reference low-level signal VSS1 not to be sent to the current scanning line G(N), and the second controllable switch T42 controls the second reference low-level signal VSS2 not to be sent to the output end Q(N) of the pull-up control assembly 100.

The first pull-down maintaining control unit 620 comprises the third controllable switch T51, the fourth controllable switch T53, and the fifth controllable switch T54. The pull-down maintaining signal LC further comprises the second pull-down maintaining signal LC2, where logical operation of the first pull-down maintaining signal LC1 is opposite to logical operation of the second pull-down maintaining signal LC2. The third controllable switch T51 uses the diode connection method. In the diode connection method, the first pull-down maintaining signal LC1 is sent to the input end and the control end of the third controllable switch T51, and the output end of the third controllable switch T51 is coupled to the control end of the fourth controllable switch T53. The first pull-down maintaining signal LC1 is sent to the input end of the fourth controllable switch T53, and the output end of the fourth controllable switch T53 is coupled to the control ends of the first controllable switch T32 and the second controllable switch T42. The second pull-down maintaining signal LC2 is sent to the control end of the fifth controllable switch T54, the first pull-down maintaining signal LC1 is sent to the input end of the fifth controllable switch T54, and the output end of the fifth controllable switch T54 is coupled to the control ends of the first controllable switch T32 and the second controllable switch T42.

The pull-down maintaining assembly 10 comprises the turn-off unit 900, where the turn-off unit 900 comprises the sixth controllable switch T52. The control end of the sixth controllable switch T52 is coupled to the output end Q(N) of the pull-up control assembly 100, the input end of the sixth controllable switch T52 is coupled to the control end of the fourth controllable switch T53, and the second reference low-level signal VSS2 or the second pull-down maintaining signal LC2 is sent to the output end of the sixth controllable switch T52.

The pull-down maintaining assembly 10 further comprises the second pull-down maintaining assembly 700, where the second pull-down maintaining assembly 700 comprises the second pull-down maintaining unit 710 and the second pull-down maintaining control unit 720 that drives the second pull-down maintaining unit 710. The pull-down maintaining signal LC further comprises the second pull-down maintaining signal LC2, where logical operation of the first pull-down maintaining signal LC1 is opposite to logical operation of the second pull-down maintaining signal LC2. The second pull-down maintaining unit 710 comprises the eighth controllable switch T33 and the ninth controllable switch T43, where the second pull-down maintaining signal LC2 is sent to control ends of the eighth controllable switch T33 and the ninth controllable switch T43 through the second pull-down maintaining control unit 720. The first reference low-level signal VSS1 is sent to the current scanning line G(N) through the eighth controllable switch T33, and the second reference low-level signal VSS2 is sent to the output end of the pull-up control assembly 100 through the ninth controllable switch T43.

When the current scanning line G(N) is inactive, the first pull-down maintaining unit 610 and the second pull-down maintaining unit 710 alternately turn on. When the second pull-down maintaining unit 710 turns on, the eighth controllable switch T33 and the ninth controllable switch T43 turn on, and the first reference low-level signal VSS1 is sent to the current scanning line G(N) and the second reference low-level signal VSS2 is sent to the output end Q(N) of the pull-up control assembly 100.

When the current scanning line G(N) is active, the first pull-down maintaining unit 610 and the second pull-down maintaining unit 710 turn off, and the first controllable switch T32, the second controllable switch T42, the eighth controllable switch T33, and the ninth controllable switch T43 turn off, which makes the first reference low-level signal VSS1 not to be sent to the current scanning line G(N), and the second reference low-level signal VSS2 not to be sent to the output end Q(N) of the pull-up control assembly 100. The pull-down maintaining assembly is divided into two assemblies, where two pull-down maintaining assemblies alternately work, thus allowing one of the two pull-down maintaining assemblies to be at the inactive status for the half work time, thus, it avoids change of the electric potential of the TFT at turn-on statuses and turn-off statuses because of long-term work of single pull-down maintaining assembly. This further avoids influence on turn-on of the pull-down maintaining assembly because of the change of the electric potential of the TFT at turn-on status, and influence on turn-off of the pull-down maintaining assembly because of the change of the electric potentials of the TFT at turn-off status, thereby improving stability of the circuit of the GOA.

The second pull-down maintaining control unit 720 comprises the tenth controllable switch T61, the eleventh controllable switch T63, and the twelfth controllable switch T64, where the tenth controllable switch T61 uses the diode connection method. In the diode connection method, the second pull-down maintaining signal LC2 is sent to the input end and the control end of the tenth controllable switch T61, the output end of the tenth controllable switch T61 is coupled to the control ends of the eighth controllable switch T33 and the ninth controllable switch T43, and the output end of the tenth controllable switch T61 is coupled to the control end of the eleventh controllable switch T63. The second pull-down maintaining signal LC2 is sent to the input end of the eleventh controllable switch T63, and the output end of the eleventh controllable switch T63 is coupled to the control ends of the eighth controllable switch T33 and the ninth controllable switch T43. The first pull-down maintaining signal LC1 is sent to the control end of the twelfth controllable switch T64, the second pull-down maintaining signal LC2 is sent to the input end of the twelfth controllable switch T64, and the output end of the twelfth controllable switch T64 is coupled to the control ends of the eighth controllable switch T33 and the ninth controllable switch T43.

When the current scanning line G(N) is inactive, the second pull-down maintaining assembly 700 turns on, and the tenth controllable switch T61, the eleventh controllable switch T63, and the twelfth controllable switch T64 control the eighth controllable switch T33 and the ninth controllable switch T43 to turn on according to the first pull-down maintaining signal LC1 and the second pull-down maintaining signal LC2, which makes the first reference low-level signal VSS1 to be sent to the current scanning line G(N), and the second reference low-level signal VSS2 to be sent to the output end Q(N) of the pull-up control assembly 100.

The pull-down maintaining assembly 10 comprises the balance bridge unit 800, where the balance bridge unit 800 comprises the diverter switch T55, and the control end of the diverter switch T55 is coupled to the output end Q(N) of the pull-up control assembly 100. The diverter switch T55 is arranged between the control ends of the first controllable switch T32 and the second controllable switch T42 and control ends of the eighth controllable switch T33 and the ninth controllable switch T43.

When the current scanning line G(N) is active, the diverter switch T55 turns on, thus, the first pull-down maintaining unit 610 is connected to the control end of the second pull-down maintaining unit 710, and electric potential of one of the control ends of the first pull-down maintaining unit 610 and the second pull-down maintaining unit 710, that is at high level, is reduced by electric potential of another control end that is at low level, thereby turning off the first pull-down maintaining unit 610 and the second pull-down maintaining unit 710. The diverter switch T55 is used to balance the electric potential of the first pull-down maintaining unit 610 and the second pull-down maintaining unit 710. Under the condition that the sixth controllable switch T52 and the thirteenth controllable switch T62 are out of work, when the diverter switch T55 is on, the electric potential of point P(N) is reduce to the electric potential of point K (N) through the diverter switch T55, which turns off the first controllable switch T32 and the second controllable switch T42. Thus, influence on the signals of the G(N) and the Q(N), that is caused because the TFTs do not turn off together, is avoided, and influence on the GOA circuit is further avoided.

The turn-off unit 900 further comprises the thirteenth controllable switch T62, where the control end of the thirteenth controllable switch T62 is coupled to the output end Q(N) of the pull-up control assembly 100, the input end of the thirteenth controllable switch T62 is coupled to the control end of the eleventh controllable switch T63, and the second reference low-level signal VSS2 or the first reference low-level signal VSS1 is sent to the output end of the thirteenth controllable switch T62. When the current scanning line G(N) is active, the sixth controllable switch T52 and the thirteenth controllable switch T62 reduce electric potentials of point S(N) of the control end of the fourth controllable switch T53 and point T(N) of the control end of the eleventh controllable switch T63, which in turn reduces electric potentials of point P(N) of the control ends of the first controllable switch T32 and the second controllable switch T42 and point K(N) of the control ends of the eighth controllable switch T33 and the ninth controllable switch T43, and further turns off the pull-down maintaining assembly, thereby avoiding the pull-down maintaining assembly from affecting the output of the GOA circuit. Because the electric potentials of the second reference low-level signal VSS2 and the first pull-down maintaining signal LC1, that are at low level, are less than the electric potential of the first reference low-level signal VSS1, voltage difference Vg between the control end and output end of the first controllable switch T32 is less than zero, voltage difference Vg between the control end and output end of the second controllable switch T42 is less than zero, voltage difference Vg between the control end and output end of the eighth controllable switch T33 is less than zero, and voltage difference Vg between the control end and output end of the ninth controllable switch T43 is less than zero, namely the first controllable switch T32, the second controllable switch T42, the eighth controllable switch T33, and the ninth controllable switch T43 are at turn-off status, which reduces the current leakage of the GOA circuit.

The electric potentials of the first pull-down maintaining signal LC1 and the second pull-down maintaining signal LC2, that are at low level, are not only less than the electric potential of the reference low-level signal VSS, but also the first pull-down maintaining signal LC1 and the second pull-down maintaining signal LC2 are low frequency signals. Switching time of the first pull-down maintaining signal LC1 and the second pull-down maintaining signal LC2 happens in a blanking time between each of the frames.

The pull-up control assembly 100 comprises the seventeenth controllable switch T11, where the output end of the seventeenth controllable switch T11 is coupled to the control end of the pull-up assembly 200. The pull-up control signal ST(N−2)/G(N−2) comprises the previous scanning line G(N−2) and the previous down-transmitting signal ST(N−2), where the previous down-transmitting signal ST(N−2) is sent to the control end of the seventeenth controllable switch T11, and the input end of the seventeenth controllable switch T11 is coupled to the previous scanning line G(N−2). The pull-up assembly 200 further comprises the eighteenth controllable switch T21, where the input end of the eighteenth controllable switch T21 is coupled to the output end Q(N) of the pull-up control assembly 100, the clock scanning signal CK is sent to the input end of the eighteenth controllable switch T21, and the output end of the eighteenth controllable switch T21 is coupled to the current scanning line G(N). The scan driving circuit further comprises the storage capacitor Cb, where the first end of the storage capacitor Cb is coupled to the output end Q(N) of the pull-up control assembly 100, and the second end of the storage capacitor Cb is coupled to the output end of the pull-up assembly 200.

The scan driving circuit further comprises the down-transmitting assembly 300, where the control end of the down-transmission 300 is coupled to the output end Q(N) of the pull-up control assembly 100 and the control end of the pull-up assembly 200, the clock scanning signal CK is sent to the input end of the down-transmitting assembly 300, and the output end of the down-transmitting assembly 300 outputs the current down-transmitting signal ST(N).

The down-transmitting assembly 300 comprises the nineteenth controllable switch T22, where the control end of the nineteenth controllable switch T22 is coupled to the output end Q(N) of the pull-up control assembly 100 and the control end of the pull-up assembly 200, the clock scanning signal CK is sent to the input end of the nineteenth controllable switch T22, and the output end of the nineteenth controllable switch T22 outputs the current down-transmitting signal ST(N). The current scanning line not only drives the next scanning line G(N+2) of circuit of next GOA, but also is regarded as the start signal of the circuit of next GOA. Thus, the start signal is not steady, thereby affecting the circuit of GOA, and further affecting display quality. In the present disclosure, the down-transmitting assembly is used, when the current scanning line drives the next scanning line, the down-transmitting assembly simultaneously generates the down-transmitting signal, and the down-transmitting signal is independent of the circuit of next GOA. Thus, steady working of the current scanning line is ensured, and even if the current scanning line G(N) is out of work, the next GOA is not affected, thereby enhancing stability of the GOA, and improving work of the GOA.

The pull-down maintaining assembly 10 further comprises a seventh controllable switch T72 and a fourteenth controllable switch T73, where a control end of the seventh controllable switch T72 is coupled to the control ends of the first controllable switch T32 and the second controllable switch T42, an input end of the seventh controllable switch T72 is coupled to the output end of the nineteenth controllable switch T22, and the second reference low-level signal VSS2 is sent to an output end of the seventh controllable switch T72. A control end of the fourteenth controllable switch T73 is coupled to the control ends of the eighth controllable switch T33 and the ninth controllable switch T43, an input end of the fourteenth controllable switch T73 is coupled to the output end of the nineteenth controllable switch T22, and the second reference low-level signal VSS2 is sent to an output end of the fourteenth controllable switch T73.

Signals of the down-transmitting assembly 300 may fluctuate when the output end of the down-transmitting assembly 300 is affected by parasitic capacitance or other factors, especially when charge generated by the parasitic capacitance cannot be completely discharged when the current scanning line G(N) is inactive. In this case, the down-transmitting signal ST(N) that is generated when the current scanning line G(N) is active, is unsteady, which affects driving of the next GOA circuit. In the example, the seventh controllable switch T72 and the fourteenth controllable switch T73 are used, when the current scanning line G(N) is active, the seventh controllable switch T72 and the fourteenth controllable switch T73 can timely and completely discharge remnant charge of the output end of the down-transmitting assembly 300 through the reference low-level signal, which ensures stability of the current down-transmitting signal ST(N), thereby improving work of next scanning line.

The first pull-down maintaining signal LC1 and the second pull-down maintaining signal LC2 are low frequency signals. Switching time of the first pull-down maintaining signal LC1 and the second pull-down maintaining signal LC2 happens in the blanking time between each of the frames.

The pull-down assembly 400 comprises the twentieth controllable switch T31 and the twenty-first controllable switch T41, where the control ends of the twentieth controllable switch T31 and the twenty-first controllable switch T41 are coupled to the next scanning line G(N+2), the input end of the twentieth controllable switch T31 is coupled to the current scanning line G(N), and the reference low-level signal VSS is sent to the output end of the twentieth controllable switch T31. The input end of the twenty-first controllable switch T41 is coupled to the output end Q(N) of the pull-up control assembly 100, and the reference low-level signal VSS is sent to the output end of the twenty-first controllable switch T41.

It should be considered that only one the pull-down maintaining assembly is arranged in the example, which also reduces the current leakage of the GOA circuit.

Example 4

Figure 5:
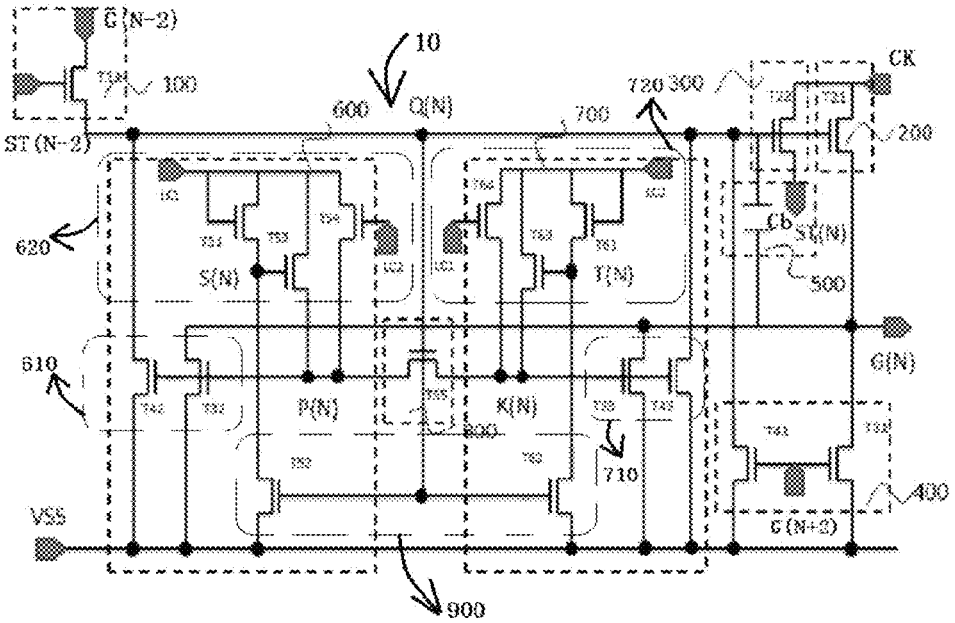
FIG. 5 is a schematic diagram of a fourth example of the scan driving circuit of the present disclosure.

FIG. 5 is a schematic diagram of a fourth example of the present disclosure, and FIG. 5 is an expanded view of the FIG. 1. The pull-down maintaining assembly 10 comprises the first pull-down maintaining assembly 600, where the first pull-down maintaining assembly 600 comprises the first pull-down maintaining unit 610 and the first pull-down maintaining control unit 620 that drives the first pull-down maintaining unit 610. The first pull-down maintaining unit 610 comprises the first controllable switch T32 and the second controllable switch T42. The pull-down maintaining signal LC comprises the first pull-down maintaining signal LC1, where the first pull-down maintaining signal LC1 is sent to the control ends of the first controllable switch T32 and the second controllable switch T42 through the first pull-down maintaining control unit 620. The reference low-level signal VSS is sent to the current scanning line G(N) through the first controllable switch T32, and the reference low-level signal VSS is sent to the output end Q(N) of the pull-up control assembly 100 through the second controllable switch T42.

When the current scanning line G(N) is inactive, the first pull-down maintaining control unit 620 controls the first controllable switch T32 and the second controllable switch T42 to turn on according to the first pull-down maintaining signal LC1. The first controllable switch T32 controls the reference low-level signal VSS to be sent to the current scanning line G(N), and the second controllable switch T42 controls the reference low-level signal VSS to be sent to the output end Q(N) of the pull-up control assembly 100.

When the current scanning line G(N) is active, the first controllable switch T32 and the second controllable switch T42 turn off. The first controllable switch T32 controls the reference low-level signal not to be sent to the current scanning line G(N), and the second controllable switch T42 controls the reference low-level signal VSS not to be sent to the output end Q(N) of the pull-up control assembly 100.

The first pull-down maintaining control unit 620 comprises the third controllable switch T51, the fourth controllable switch T53, and the fifth controllable switch T54. The pull-down maintaining signal LC further comprises the second pull-down maintaining signal LC2, where logical operation of the first pull-down maintaining signal LC1 is opposite to logical operation of the second pull-down maintaining signal LC2. The third controllable switch T51 uses the diode connection method. In the diode connection method, the first pull-down maintaining signal LC1 is sent to the input end and the control end of the third controllable switch T51, and the output end of the third controllable switch T51 is coupled to the control end of the fourth controllable switch T53. The first pull-down maintaining signal LC1 is sent to the input end of the fourth controllable switch T53, and the output end of the fourth controllable switch T53 is coupled to the control ends of the first controllable switch T32 and the second controllable switch T42. The second pull-down maintaining signal LC2 is sent to the control end of the fifth controllable switch T54, the first pull-down maintaining signal LC1 is sent to the input end of the fifth controllable switch T54, and the output end of the fifth controllable switch T54 is coupled to the control ends of the first controllable switch T32 and the second controllable switch T42.

The pull-down maintaining assembly 10 comprises the turn-off unit 900, where the turn-off unit 900 comprises the sixth controllable switch T52. The control end of the sixth controllable switch T52 is coupled to the output end Q(N) of the pull-up control assembly 100, the input end of the sixth controllable switch T52 is coupled to the control end of the fourth controllable switch T53, and the reference low-level signal VSS or the second pull-down maintaining signal LC2 is sent to the output end of the sixth controllable switch T52.

The pull-down maintaining assembly 10 further comprises the second pull-down maintaining assembly 700, where the second pull-down maintaining assembly 700 comprises the second pull-down maintaining unit 710 and the second pull-down maintaining control unit 720 that drives the second pull-down maintaining unit 710. The pull-down maintaining signal LC further comprises the second pull-down maintaining signal LC2, where logical operation of the first pull-down maintaining signal LC1 is opposite to logical operation of the second pull-down maintaining signal LC2. The second pull-down maintaining unit 710 comprises the eighth controllable switch T33 and the ninth controllable switch T43, where the second pull-down maintaining signal LC2 is sent to control ends of the eighth controllable switch T33 and the ninth controllable switch T43 through the second pull-down maintaining control unit 720. The reference low-level signal VSS is sent to the current scanning line G(N) through the eighth controllable switch T33, and the reference low-level signal VSS is sent to the output end of the pull-up control assembly 100 through the ninth controllable switch T43.

When the current scanning line G(N) is inactive, the first pull-down maintaining unit 610 and the second pull-down maintaining unit 710 alternately turn on. When the second pull-down maintaining unit 710 turns on, the eighth controllable switch T33 and the ninth controllable switch T43 turn on, and the reference low-level signal VSS is sent to the current scanning line G(N) and the output end Q(N) of the pull-up control assembly 100.

When the current scanning line G(N) is active, the first pull-down maintaining unit 610 and the second pull-down maintaining unit 710 turn off, and the first controllable switch T32, the second controllable switch T42, the eighth controllable switch T33, and the ninth controllable switch T43 turn off, which makes the reference low-level signal VSS not to be sent to the current scanning line G(N) and the output end Q(N) of the pull-up control assembly 100. The pull-down maintaining assembly is divided into two assemblies, two pull-down maintaining assemblies alternately work, thus allowing one of the two pull-down maintaining assemblies to be at the inactive status for the half work time, thus, it avoids change of the electric potential of the TFT at turn-on statuses and turn-off statuses because of long-term work of single pull-down maintaining assembly. This further avoids influence on turn-on of the pull-down maintaining assembly because of the change of the electric potential of the TFT at turn-on status, and influence on turn-off of the pull-down maintaining assembly because of the change of the electric potentials of the TFT at turn-off status, thereby improving stability of the circuit of the GOA.

The second pull-down maintaining control unit 720 comprises the tenth controllable switch T61, the eleventh controllable switch T63, and the twelfth controllable switch T64, where the tenth controllable switch T61 uses the diode connection method. In the diode connection method, the second pull-down maintaining signal LC2 is sent to the input end and the control end of the tenth controllable switch T61, and the output end of the tenth controllable switch T61 is coupled to the control end of the eleventh controllable switch T63. The second pull-down maintaining signal LC2 is sent to the input end of the eleventh controllable switch T63, and the output end of the eleventh controllable switch T63 is coupled to the control ends of the eighth controllable switch T33 and the ninth controllable switch T43. The first pull-down maintaining signal LC1 is sent to the control end of the twelfth controllable switch T64, the second pull-down maintaining signal LC2 is sent to the input end of the twelfth controllable switch T64, and the output end of the twelfth controllable switch T64 is coupled to the control ends of the eighth controllable switch T33 and the ninth controllable switch T43.

When the current scanning line G(N) is inactive, the second pull-down maintaining assembly 700 turns on, and the tenth controllable switch T61, the eleventh controllable switch T63, and the twelfth controllable switch T64 control the eighth controllable switch T33 and the ninth controllable switch T43 to turn on according to the first pull-down maintaining signal LC1 and the second pull-down maintaining signal LC2, which makes the reference low-level signal VSS to be sent to the current scanning line G(N) and the output end Q(N) of the pull-up control assembly 100.

The pull-down maintaining assembly 10 comprises the balance bridge unit 800, where the balance bridge unit 800 comprises the diverter switch T55, and the control end of the diverter switch T55 is coupled to the output end Q(N) of the pull-up control assembly 100. The diverter switch T55 is arranged between the control ends of the first controllable switch T32 and the second controllable switch T42 and the control ends of the eighth controllable switch T33 and the ninth controllable switch T43.

When the current scanning line G(N) is active, the diverter switch T55 turns on, thus, the first pull-down maintaining unit 610 is connected to the control end of the second pull-down maintaining unit 710, and electric potential of one of the control ends of the first pull-down maintaining unit 610 and the second pull-down maintaining unit 710, that is at high level, is reduced by electric potential of another control end that is at low level, thereby turning off the first pull-down maintaining unit 610 and the second pull-down maintaining unit 710. The diverter switch T55 is used to balance the electric potential of the first pull-down maintaining unit 610 and the second pull-down maintaining unit 710. Under the condition that the sixth controllable switch T52 and the thirteenth controllable switch T62 are out of work, when the diverter switch T55 is on, the electric potential of point P(N) is reduced to the electric potential of point K(N) through the diverter switch T55, which turns off the first controllable switch T32, the second controllable switch T42, the eighth controllable switch T33, and the ninth controllable switch T43. Thus, influence on the signals of the G(N) and the Q(N), that is caused because the TFTs do not turn off together, is avoided, and influence on the GOA circuit is further avoided.

The turn-off unit 900 further comprises the thirteenth controllable switch T62, where the control end of the thirteenth controllable switch T62 is coupled to the output end Q(N) of the pull-up control assembly 100, the input end of the thirteenth controllable switch T62 is coupled to the control end of the eleventh controllable switch T63, and the reference low-level signal VSS and the first pull-down maintaining signal LC1 are sent to the output end of the thirteenth controllable switch T62. When the current scanning line G(N) is active, the sixth controllable switch T52 and the thirteenth controllable switch T62 reduce electric potentials of point S(N) of the control end of the fourth controllable switch T53 and point T(N) of the control end of the eleventh controllable switch T63, which in turn reduces electric potential of point P(N) of the control ends of the first controllable switch T32 and the second controllable switch T42 and electric potential of point K(N) of the control ends of the eighth controllable switch T33 and the ninth controllable switch T43, thereby turning off the pull-down maintaining assembly, and avoiding influence on the GOA circuit from the pull-down maintaining assembly. Because the electric potentials of the second reference low-level signal VSS2 and the first pull-down maintaining signal LC1, that are at low level, are less than the electric potential of the first reference low-level signal VSS1, voltage difference Vg between the control end and output end of the first controllable switch T32 is less than zero, voltage difference Vg between the control end and output end of the second controllable switch T42 is less than zero, voltage difference Vg between the control end and output end of the eighth controllable switch T33 is less than zero, and voltage difference Vg between the control end and output end of the ninth controllable switch T43 is less than zero, namely the first controllable switch T32, the second controllable switch T42, the eighth controllable switch T33, and the ninth controllable switch T43 are at turn-off status, which reduces the current leakage of the GOA circuit.

The electric potentials of the first pull-down maintaining signal LC1 and the second pull-down maintaining signal LC2 are not only less than the electric potential of the reference low-level signal VSS, but also the first pull-down maintaining signal LC1 and the second pull-down maintaining signal LC2 are low frequency signals. Switching time of the first pull-down maintaining signal LC1 and the second pull-down maintaining signal LC2 happens in the blanking time between each of the frames.

The pull-up control assembly 100 comprises the seventeenth controllable switch T11, where the output end of the seventeenth controllable switch T11 is coupled to the control end of the pull-up assembly 200. The pull-up control signal ST(N−2)/G(N−2) comprises the previous scanning line G(N−2) and the previous down-transmitting signal ST(N−2), where the previous down-transmitting signal ST(N−2) is sent to the control end of the seventeenth controllable switch T11, and an input end of the seventeenth controllable switch T11 is coupled to the previous scanning line G(N−2). The pull-up assembly 200 further comprises the eighteenth controllable switch T21, where the input end of the eighteenth controllable switch T21 is coupled to the output end Q(N) of the pull-up control assembly 100, the clock scanning signal CK is sent to the input end of the eighteenth controllable switch T21, and the output end of the eighteenth controllable switch T21 is coupled to the current scanning line G(N). The scan driving circuit further comprises the storage capacitor Cb, where the first end of the storage capacitor Cb is coupled to the output end Q(N) of the pull-up control assembly 100, and the second end of the storage capacitor Cb is coupled to the output end of the pull-up assembly 200.

The electric potentials of the first pull-down maintaining signal LC1 and the second pull-down maintaining signal LC2 are low frequency signals. Switching time of the first pull-down maintaining signal LC1 and the second pull-down maintaining signal LC2 happens in the blanking time between each of the frames.

The pull-down assembly 400 comprises the twentieth controllable switch T31 and the twenty-first controllable switch T41, where the control ends of the twentieth controllable switch T31 and the twenty-first controllable switch T41 is coupled to the next scanning line G(N+2), the input end of the twentieth controllable switch T31 is coupled to the current scanning line G(N), and the reference low-level signal VSS is sent to the output end of the twentieth controllable switch T31. The input end of the twenty-first controllable switch T41 is coupled to the output end Q(N) of the pull-up control assembly 100, and the reference low-level signal VSS is sent to the output end of the twenty-first controllable switch T41.

It should be considered that only one the pull-down maintaining assembly is arranged in the example, which also improves the current leakage of the GOA circuit.

Example 5

Figure 6:
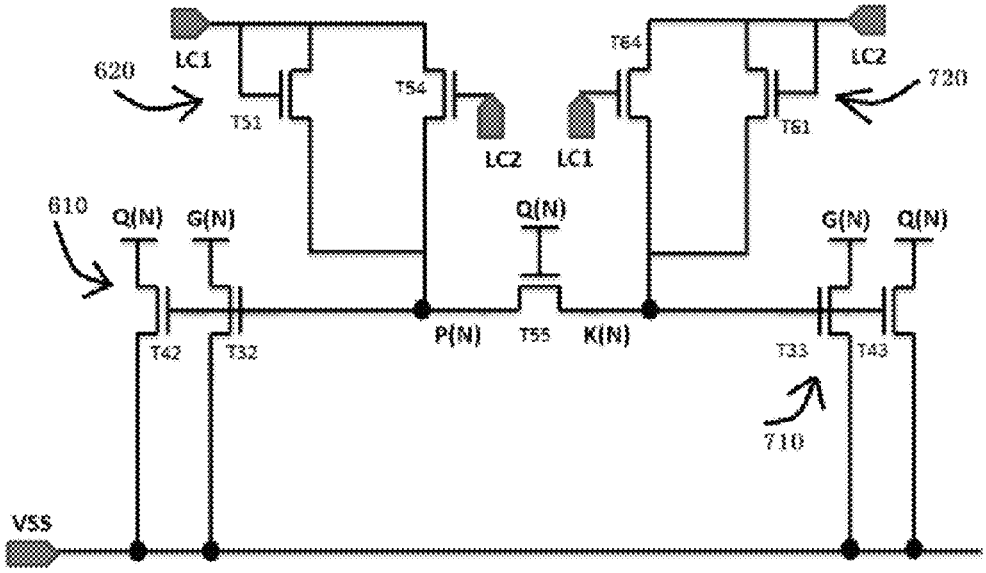
FIG. 6 is a first schematic diagram of a fifth example of the scan driving circuit of the present disclosure.

FIG. 6-FIG. 9 are schematic diagrams of a fifth example of the present disclosure:

FIG. 6 is a first schematic diagram of the fifth example of the present disclosure and is a portion structure of the scan driving circuit of the present disclosure. Compared with the pull-down maintaining assemblies 10 of the second example and the third example, the pull-down maintaining assembly 10 of the fifth example is different from the pull-down maintaining assemblies 10 of the second example and the third example. In the example, the first pull-down maintaining control unit 620 comprises the third controllable switch T51 and the fifth controllable switch T54, and the second pull-down maintaining control unit 720 comprises the tenth controllable switch T61 and the eleventh controllable switch T63. The third controllable switch T51 and the tenth controllable switch T61 use the diode connection method. In the diode connection method, t the first pull-down maintaining signal LC1 is sent to the control end and the input end of the third controllable switch T51, the second pull-down maintaining signal LC2 is sent to the input end and the control end of the tenth controllable switch T61. The output end of the third controllable switch T51 is coupled to point P(N) of the control ends of the first controllable switch T32 and the second controllable switch T42, and the output end of the tenth controllable switch T61 is coupled to point K(N) of the control ends of the eighth controllable switch T33 and the ninth controllable switch T43.

The pull-down maintaining assembly 10 comprises the balance bridge unit 800, where the balance bridge unit 800 comprises the diverter switch T55, and the control end of the diverter switch T55 is coupled to the output end Q(N) of the pull-up control assembly 100. The diverter switch T55 is arranged between point P(N) of the control ends of the first controllable switch T32 and the second controllable switch T42 and point K(N) of the control ends of the eighth controllable switch T33 and the ninth controllable switch T43. The diverter switch T55 is used to balance the electric potential of the first pull-down maintaining unit 610 and the second pull-down maintaining unit 710. Under the condition that the sixth controllable switch T52 and the thirteenth controllable switch T62 are out of work, when the diverter switch T55 is on, the electric potential of point P(N) is reduced to the electric potential of point K(N) through the diverter switch T55, which turns off the first controllable switch T32, the second controllable switch T42, the eighth controllable switch T33 and the ninth controllable switch T43. Thus, influence on the signals of the G(N) and the Q(N), that is caused because the TFTs do not turn off together, is avoided, and influence on the GOA circuit is further avoided.

Figure 7:
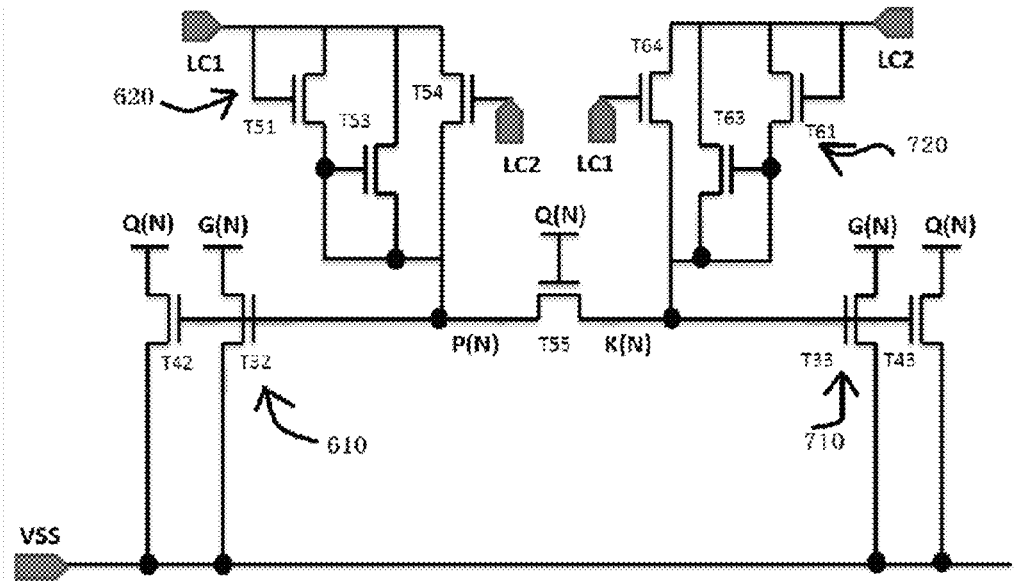
FIG. 7 is a second schematic diagram of the fifth example of the scan driving circuit of the present disclosure.

FIG. 7 is a second schematic diagram of the fifth example of the scan driving circuit of the present disclosure. The difference between FIG. 6 and FIG. 7 is that: the first pull-down maintaining control unit 620 comprises the fourth controllable switch T53, and the second pull-down maintaining control unit 720 comprises the eleventh controllable switch T63, where the control end of the fourth controllable switch T53 is coupled to the output end of the third controllable switch T51, the output end of the fourth controllable switch T53 is coupled to the output end of the third controllable switch T51 and the control ends of the first controllable switch T32 and the second controllable switch T42. The first pull-down maintaining signal LC1 and the second pull-down maintaining signal LC2 are sent to the input end of the fourth controllable switch T53. The control end of the eleventh controllable switch T63 is coupled to the output end of the tenth controllable switch T61, the output end of the eleventh controllable switch T63 is coupled to the output end of the tenth controllable switch T61 and the control ends of the eighth controllable switch T33 and the ninth controllable switch T43. The first pull-down maintaining signal LC1 and the second pull-down maintaining signal LC2 are sent to the input end of the eleventh controllable switch T63.

Figure 8:
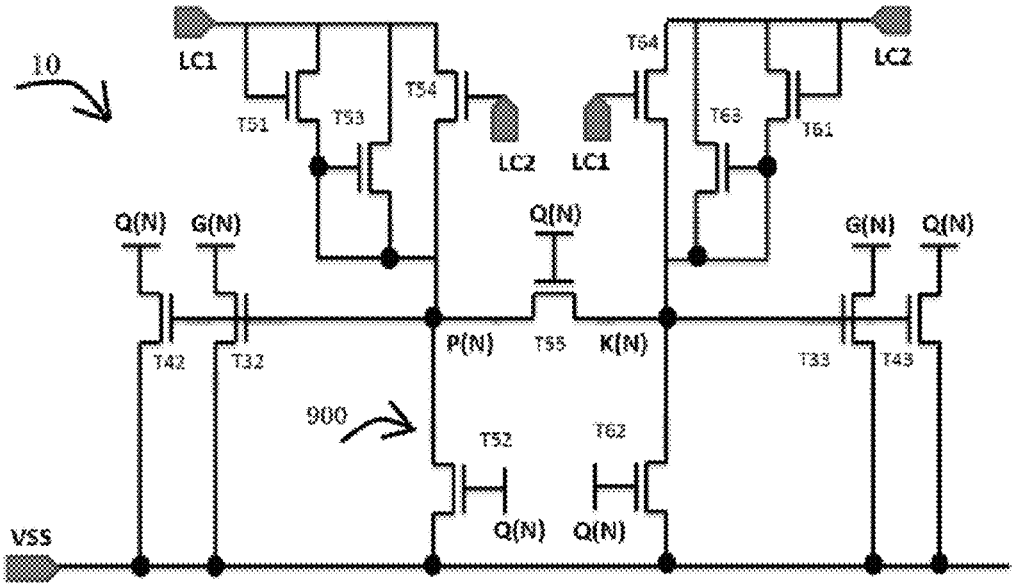
FIG. 8 is a third schematic diagram of the fifth example of the scan driving circuit of the present disclosure.

FIG. 8 is a third schematic diagram of the fifth example of the scan driving circuit of the present disclosure. Compared with other schematic diagrams, the pull-down maintaining assembly 10 comprises the turn-off unit 900, the turn-off unit 900 comprises the sixth controllable switch T52 and the thirteenth controllable switch T62, where the control end of the sixth controllable switch T52 is coupled to the output end Q(N) of the pull-up control assembly 100, the input end of the sixth controllable switch T52 is coupled to point P(N) of the control end of the first controllable switch T32 and the second controllable switch T42, and the reference low-level signal VSS is sent to the output end of the sixth controllable switch T52. The control end of the thirteenth controllable switch T62 is coupled to the output end Q(N) of the pull-up control assembly 100, the input end of the thirteenth controllable switch T62 is coupled to point K(N) of the control ends of the eighth controllable switch T33 and the ninth controllable switch T43, and the reference low-level signal VSS is sent to the output end of the thirteenth controllable switch T62.

When the current scanning line G(N) is active, the sixth controllable switch T52 and the thirteenth controllable switch T62 reduces electric potentials of points P(N) and K(N), thereby turning off the pull-down maintaining assembly, and avoiding influence on the GOA circuit from the pull-down maintaining assembly.

Figure 9:
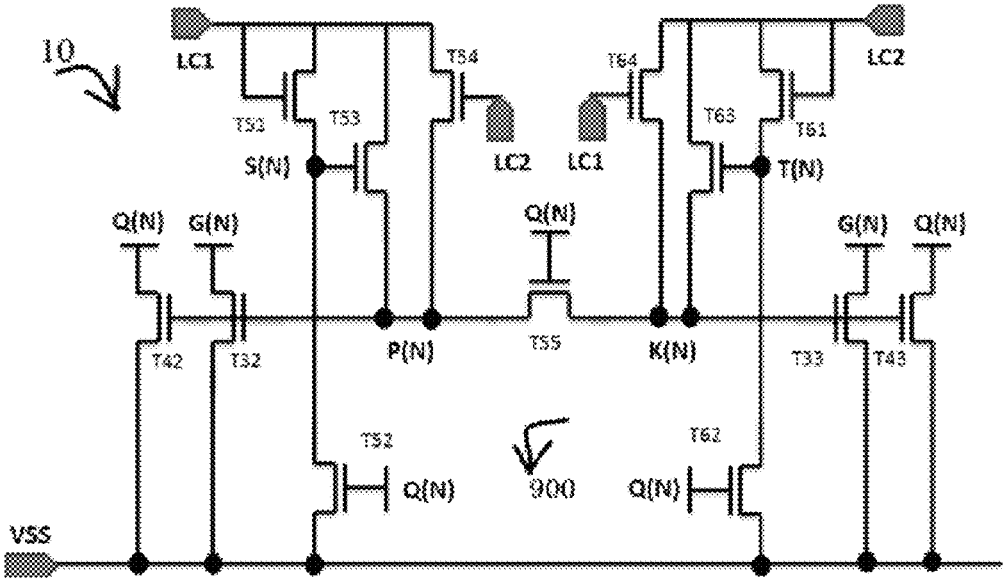
FIG. 9 is a fourth schematic diagram of the fifth example of the scan driving circuit of the present disclosure.

FIG. 9 is a fourth schematic diagram of the fifth example of the scan driving circuit of the present disclosure and FIG. 9 is improved according to the FIG. 7. In the example, the pull-down maintaining assembly 10 comprises the turn-off unit 900, where the turn-off unit 900 comprises the sixth controllable switch T52 and the thirteenth controllable switch T62, where the control end of the sixth controllable switch T52 is coupled to the output end Q(N) of the pull-up control assembly 100, the input end of the sixth controllable switch T52 is coupled to point S(N) of the control end of the fourth controllable switch T53, and the reference low-level signal VSS is sent to the output end of the sixth controllable switch T52. The control end of the thirteenth controllable switch T62 is coupled to the output end Q(N) of the pull-up control assembly 100, the input end of the thirteenth controllable switch T62 is coupled to point T(N) of the control end of the eleventh controllable switch T63, and the reference low-level signal VSS is sent to the output end of the thirteenth controllable switch T62.

In the example, the reference low-level signal VSS comprises the first reference low-level signal VSS1 and the second reference low-level signal VSS2.

Example 6

Figure 10:
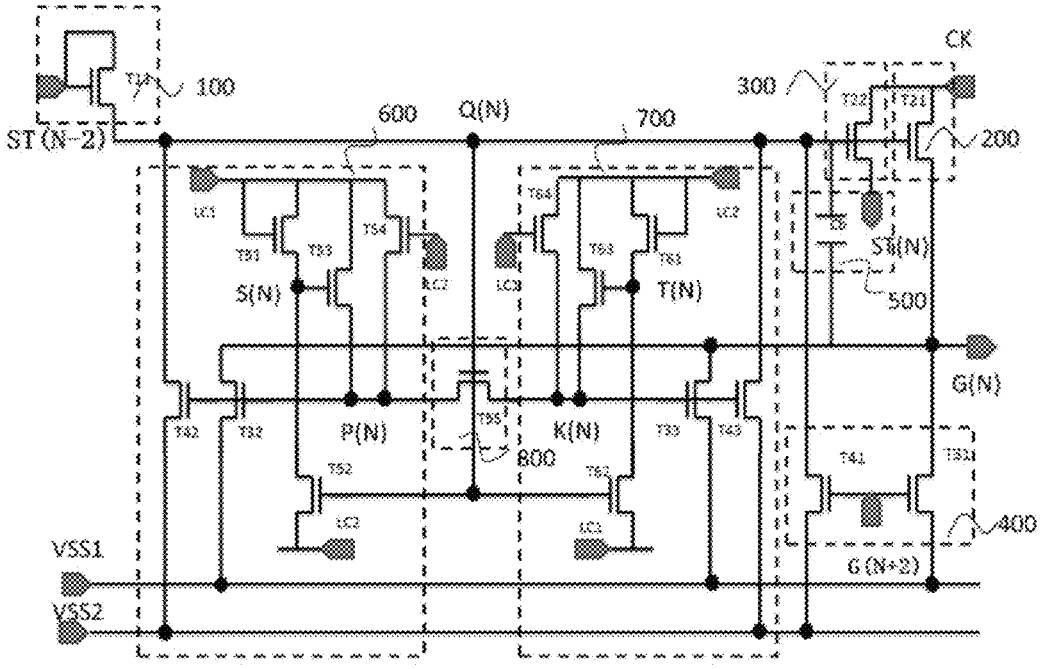
FIG. 10 is a first schematic diagram of a sixth example of the scan driving circuit of the present disclosure.

FIG. 10 is a first schematic diagram of a sixth example of the present disclosure. Compared with the first example, the second example, the third example, the fourth example, and the fifth example, in the example, the previous down-transmitting signal ST(N−2) is sent to the control end and the input end of the pull-up control assembly 100, which avoids influence on the GOA circuit from the previous scanning line G(N−2).

Figure 11:
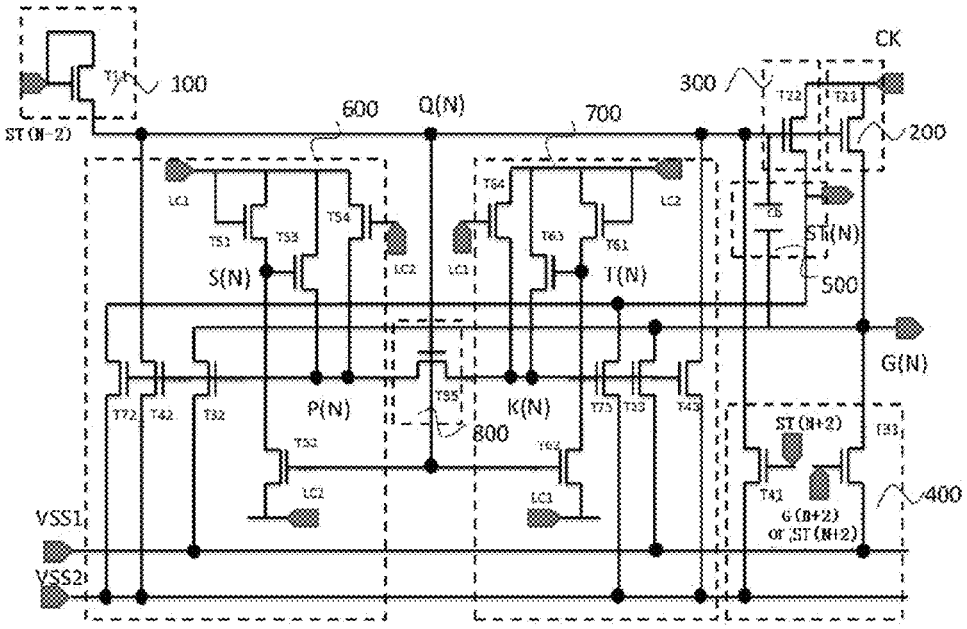
FIG. 11 is a second schematic diagram of the sixth example of the scan driving circuit of the present disclosure.

FIG. 11 is a second schematic diagram of the sixth example of the present disclosure. The difference between FIG. 10 and FIG. 11 is that: the control end of the twentieth controllable switch T31 of the pull-down assembly 400 is coupled to the next scanning line G(N+2), or a next down-transmitting signal ST(N+2) is sent to the control end of the twentieth controllable switch T31 of the pull-down assembly 400. The next down-transmitting signal ST(N+2) is sent to the control end of the twenty-first controllable switch T41.

Figure 12:
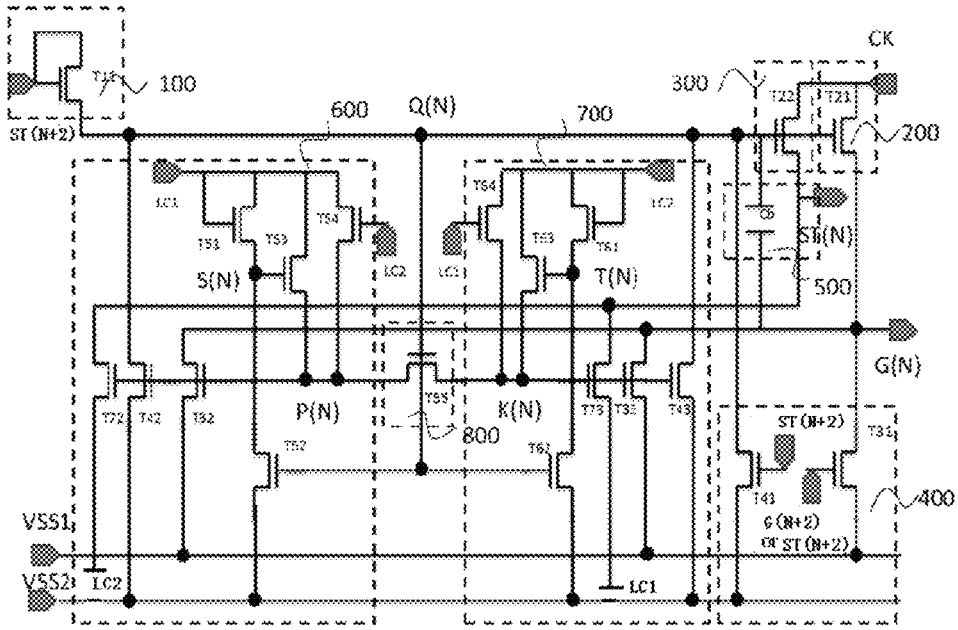
FIG. 12 is a third schematic diagram of the sixth example of the scan driving circuit of the present disclosure.

FIG. 12 is a third schematic diagram of the sixth example of the present disclosure. The difference between FIG. 12 and FIG. 11 is that: the second pull-down maintaining signal LC2 is sent to the output end of the seventh controllable switch T72, and the first pull-down maintaining signal LC1 is sent to the fourteenth controllable switch T73.

Example 7

Figure 13:
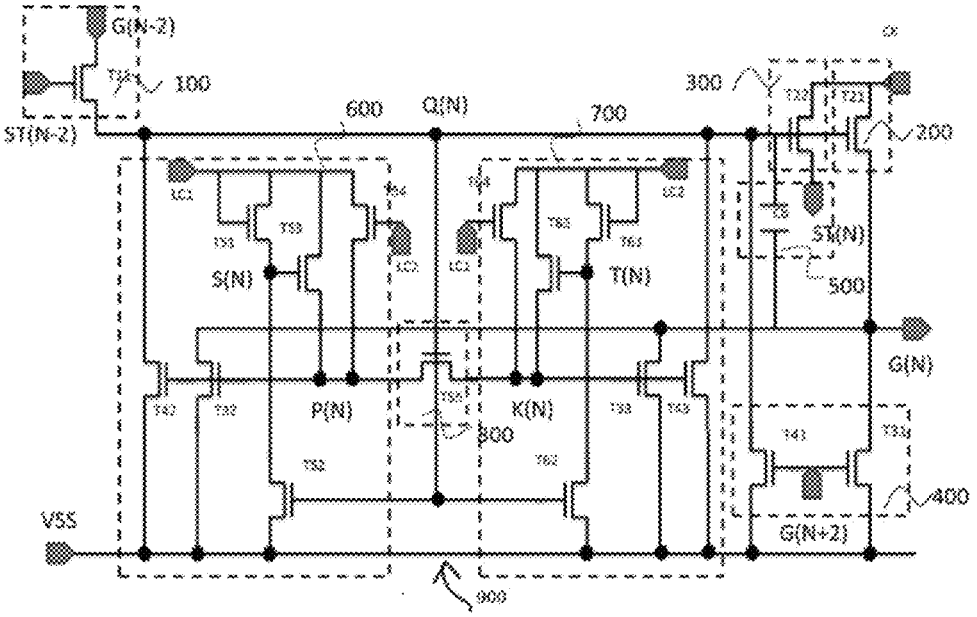
FIG. 13 is a schematic diagram of a seventh example of the scan driving circuit of the present disclosure.
Figure 14:
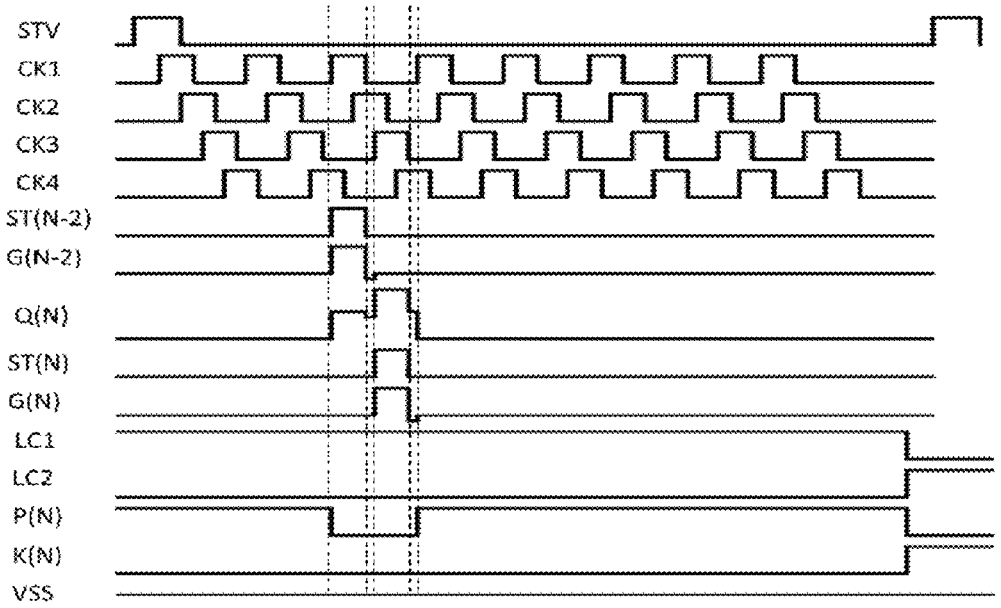
FIG. 14 is a first signal waveform diagram of the seventh example of the scan driving circuit of the present disclosure.
Figure 15:
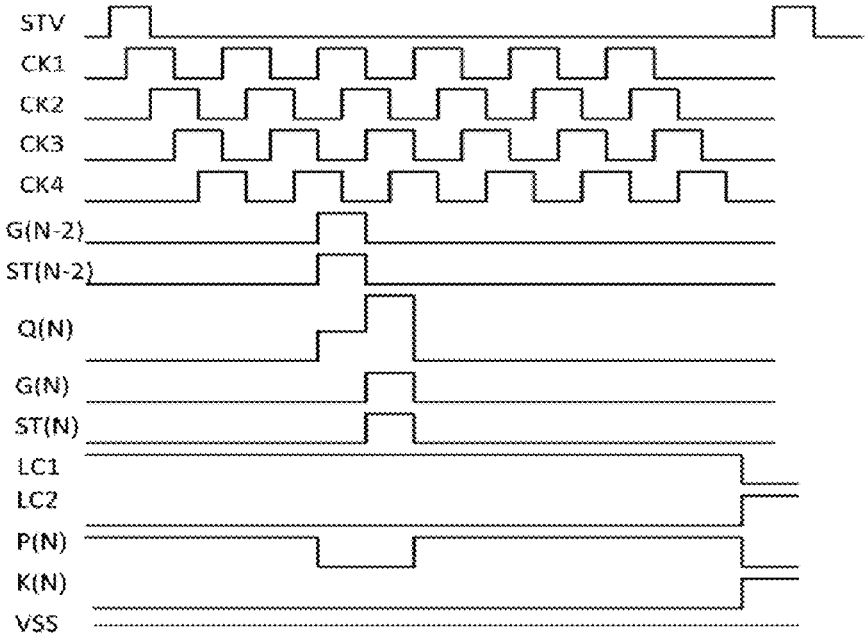
FIG. 15 is a second signal waveform diagram of the seventh example of the scan driving circuit of the present disclosure.

FIG. 13 is a schematic diagram of a seventh example of the scan driving circuit of the present disclosure. FIG. 14 and FIG. 15 are signal waveform diagrams of the seventh example of the scan driving circuit of the present disclosure. In the example, the first pull-down maintaining signal LC1 and the second pull-down maintaining signal LC2 are low frequency signal. The low-frequency signal can avoid signal fluctuation of the GOA circuit due to change of the electric potential that is generated during switching the high-frequency between the high-level and the low-level, and combined with the pull-down maintaining assembly, the low-frequency signal allows the pulse periods of the first pull-down maintaining signal LC1 and the second pull-down maintaining signal LC2 not to be limited, and the first pull-down maintaining signal LC1 and the second pull-down maintaining signal LC2 can be used when the electric potentials thereof are complementary, it is good that the switching time the signal happens in the blanking time between each frame image. Thus, failure of the GOA due to mismatching waveforms of the pull-down maintaining signal and the pull-down maintaining signal is avoided, thereby improving the stability of the GOA circuit.

FIG. 14 is a waveform diagram of the clock scanning signal having duty cycle of 40/60, the clock scanning signal is used to generate high electric potential of the current scanning line G(N), and the pull-down maintaining signal LC is used to control high and low electric potentials of the pull-down maintaining circuit. For example, when the current scanning line G(N) is active, the electric potentials of points P(N) and K(N) are reduced to the low electric potential of the pull-down maintaining signal LC, namely the electric potentials of the control ends of a plurality of TFTs that are used in the pull-down maintaining circuit, such as the first controllable switch T32 and the second controllable switch T42, are at the turn-off status that is less than the electric potential of the reference low-level signal VSS when the current scanning line G(N) is active, which ensures the GOA circuit to work. The reference low-level signal VSS is used to reduce the electric potentials of the current scanning line G(N), the output end Q(N) of the pull-up control assembly, point S(N), and point T(N). When the duty cycle of the clock scanning signal is 40/60, the electric potential of the current scanning line G(N) is reduced to the low electric potential of the clock scanning signal CKL after the current scanning line G(N) is inactive, and then the electric potential of the current scanning line G(N) is increased to the electric potential of the reference low-level signal VSS, the electric potential of the clock scanning signal CKL is usually less than the electric potential of the reference low-level signal VSS, thus, the current scanning line G(N) is driven through three stages, thereby avoiding clock feedthrough effects of the TFTs in the pixel display area.

STV is a start signal of the GOA circuit. The start signal STV of the GOA circuit is used to start a first stage GOA circuit, or the first and a second GOA circuits, and the start signal STV of the GOA circuit is also used to reduce the electric potentials of the output ends Q(N) of the pull-up control assemblies of last stage GOA circuit or last two stage GOA circuits.

The signals, that are used to output, input, pull up, and pull down, are generated in a work process of the GOA circuit. When the high-frequency clock scanning signal having duty ratio of 40/60 is used, the waveform of the output end Q(N) of the pull-up control assembly is similar to the Chinese character "凸".

FIG. 15 is a waveform diagram of the clock scanning signal having a duty cycle of 50/50. Compared with FIG. 14, when the duty cycle of the clock scanning signal is 50/50, the waveform of the output end Q(N) of the pull-up control assembly changes greatly, and the duty cycle of 50/50 can reduce current leakage of the output end Q(N) of the pull-up control assembly when switching the clock scanning signal, thereby prolonging the working time of the current scanning line.

Example 8

Figure 16:
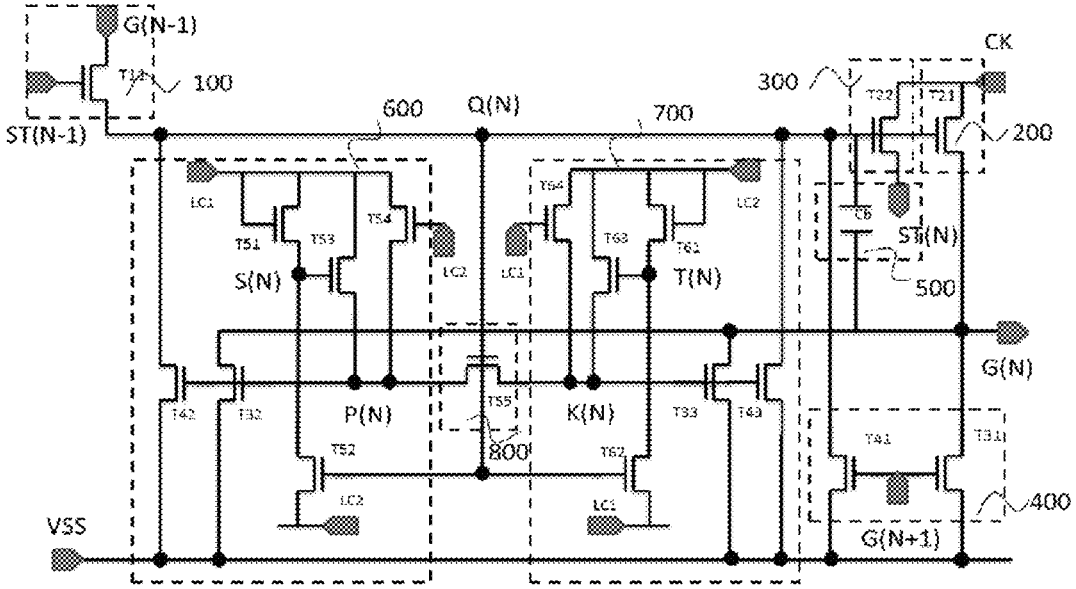
FIG. 16 is a schematic diagram of an eighth example of the scan driving circuit of the present disclosure.

FIG. 16 is a schematic diagram of an eighth example of the present disclosure, is different from the seventh example. In the example, the first and second pull-down maintaining signals (LC1, LC2) are sent to the output ends of the sixth controllable switch T52 and the thirteenth controllable switch T62, respectively, which makes the sixth controllable switch T52 and the thirteenth controllable switch T62 assist to reduce the electric potentials of the first, second, eighth, and ninth controllable switches (T32, T42, T33, T43), thus, the first, second, eighth, and ninth controllable switches (T32, T42, T33, T43) are at safe turn-off status, thereby reducing current leakage.

Figure 17:
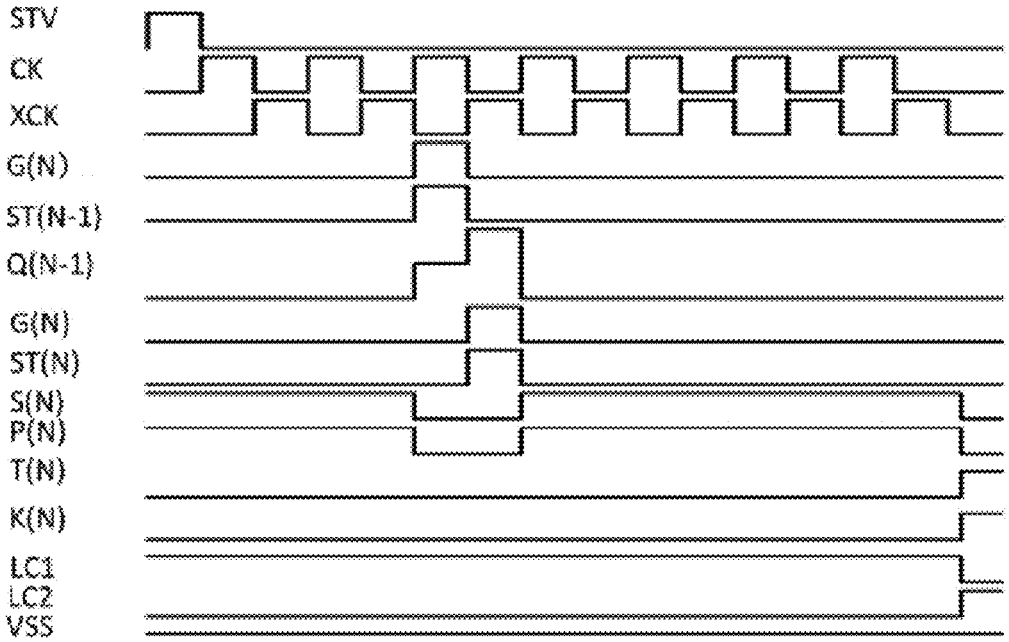
FIG. 17 is a signal waveform diagram of the eighth example of the scan driving circuit of the present disclosure.

FIG. 17 is waveform diagram of the signal of the circuit of the eighth example. Compared with FIG. 15, in FIG. 17, the waveform diagrams of the signals of points S(N) and T(N) are added.

Example 9

Figure 18:
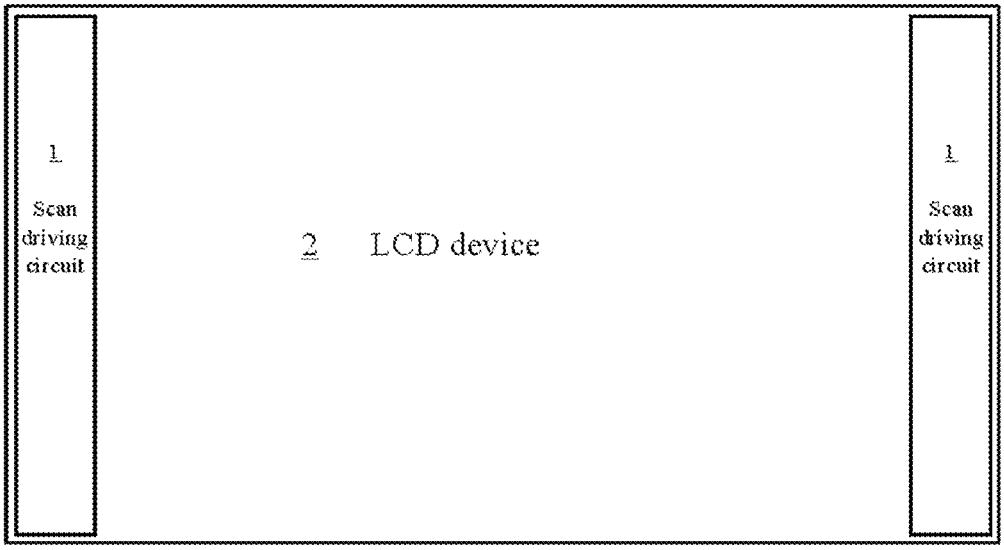
FIG. 18 is a schematic diagram of a liquid crystal display (LCD) device of the present disclosure.

FIG. 18 is a schematic diagram of the LCD device of the present disclosure, the LCD device 2 comprises the scan driving circuit 1 arranged two ends of the LCD device 2, the scan driving circuit 1 is any one of the scan driving circuits of the present disclosure.

The present disclosure is described in detail in accordance with the above contents with the specific exemplary examples. However, this present disclosure is not limited to the specific examples. For the ordinary technical personnel of the technical field of the present disclosure, on the premise of keeping the conception of, the technical personnel can also make simple deductions or replacements, and all of which should be considered to belong to the protection scope of the present disclosure.

I claim:

1. A scan driving circuit, comprising:

a pull-up assembly;

a pull-up control assembly that drives the pull-up assembly;

a pull-down maintaining assembly; and a reference low-level signal comprising a first reference low-level signal and a second reference low-level signal;

wherein an output end of the pull-up assembly is coupled to a current scanning line, an output end of the pull-up control assembly is connected to a control end of the pull-up assembly, electric potential of the second reference low-level signal is less than electric potential of the first reference low-level signal;

when the current scanning line is inactive, the second reference low-level signal is sent to the output end of the pull-up control assembly through the pull-down maintaining assembly, and the first reference low-level signal is also sent to the current scanning line through the pull-down maintaining assembly;

wherein the pull-down maintaining assembly comprises a first pull-down maintaining assembly, the first pull-down maintaining assembly comprises a first pull-down maintaining unit and a first pull-down maintaining control unit that drives the first pull-down maintaining unit; the first pull-down maintaining unit comprises a first controllable switch and a second controllable switch, the pull-down maintaining signal comprises a first pull-down maintaining signal, wherein the first pull-down maintaining signal is sent to control ends of the first controllable switch and the second controllable switch through the first pull-down maintaining control unit; the second reference low-level signal is sent to the output end of the pull-up control assembly through the second controllable switch, and the first reference low-level signal is sent to the current scanning line through the first controllable switch; electric potential of the pull-down maintaining signal, that is at a low level, is less than electric potential of the second reference low-level signal;

when the current scanning line is inactive, the first pull-down maintaining control unit controls the first controllable switch and the second controllable switch to turn on according to the first pull-down maintaining signal, the first controllable switch controls the second reference low-level signal to be sent to the output end of the pull-up control assembly, and the second controllable switch controls the first reference low-level signal to be sent to the current scanning line;

when the current scanning line is active, the first controllable switch and the second controllable switch turn off, the first controllable switch controls the second reference low-level signal not to be sent to the output end of the pull-up control assembly, and the second controllable switch controls the first reference low-level signal not to be sent to the current scanning line.

2. The scan driving circuit of claim 1, wherein the pull-down maintaining assembly comprises a first pull-down maintaining assembly, a second pull-down maintaining assembly, and a pull-down maintaining signal; input ends of the first pull-down maintaining assembly and the second pull-down maintaining assembly are coupled to the output end of the pull-up control assembly, the pull-down maintaining signal is sent to control ends of the first pull-down maintaining assembly and the second pull-down maintaining assembly, and the reference low-level signal is sent to output ends of the first pull-down maintaining assembly and the second pull-down maintaining assembly;

wherein the scan driving circuit further comprises a diverter switch, the diverter switch is connected between the control end of the first pull-down maintaining assembly and the control end of the second pull-down maintaining assembly a control end of the diverter switch is coupled to the output end of the pull-up control assembly;

when the current scanning line is active, a second controllable switch turns off the first pull-down maintaining assembly and the second pull-down maintaining assembly, causing the reference low-level signal not to be sent to the output end of the pull-up control assembly and the current scanning line.

3. The scan driving circuit of claim 2, wherein the pull-up control assembly comprises a seventeenth controllable switch; an output end of the seventeenth controllable switch is coupled to the control end of the pull-up assembly, a pull-up control signal is sent to a control end and an input end of the seventeenth controllable switch; the pull-up assembly comprises an eighteenth controllable switch, a control end of the eighteenth controllable switch is coupled to the output end of the seventeenth controllable switch, the clock scanning signal is sent to an input end of the eighteenth controllable switch, and an output end of the eighteenth controllable switch is coupled to the current scanning line; the scan driving circuit further comprises a storage capacitor, a first end of the storage capacitor is coupled to the output end of the pull-up control assembly, and a second end of the storage capacitor is coupled to the output end of the pull-up assembly.

4. The scan driving circuit of claim 1, wherein the pull-down maintaining signal comprises a second pull-down maintaining signal, logical operation of the first pull-down maintaining signal is opposite to logical operation of the second pull-down maintaining signal; the first pull-down maintaining control unit comprises a third controllable switch, a fourth controllable switch, and a fifth controllable switch; the third controllable switch uses a diode connection method; in the diode connection method, the first pull-down maintaining signal is sent to an input end and a control end of the third controllable switch, an output end of the third controllable switch is coupled to a control end of the fourth controllable switch, and the first pull-down maintaining signal is sent to an input end of the fourth controllable switch; the second pull-down maintaining signal is sent to a control end of the fifth controllable switch, the first pull-down maintaining signal is sent to an input end of the fifth controllable switch, and output ends of the fourth controllable switch and the fifth controllable switch are coupled to the control ends of the first controllable switch and the second controllable switch;

when the current scanning line is inactive, the first controllable switch and the second controllable switch turn on according to the first pull-down maintaining signal and the second pull-down maintaining signal; the first reference low-level signal reduces electric potential of the current scanning line through the first controllable switch, and the second reference low-level signal reduces electric potential of the output end of the pull-up control assembly through the second controllable switch;

when the current scanning line is active, the first controllable switch and the second controllable switch turn off, the second reference low-level signal is not sent to the output end of the pull-up control assembly, and the first reference low-level signal is not sent to the current scanning line.

5. The scan driving circuit of claim 4, wherein the pull-down maintaining assembly comprises a turn-off unit, the turn-off unit comprises a sixth controllable switch, a control end of the sixth controllable switch is coupled to the output end of the pull-up control assembly, and an input end of the sixth controllable switch is coupled to the control end of the fourth controllable switch; the first reference low-level signal, the second reference low-level signal, or the second pull-down maintaining signal is sent to an output end of the sixth controllable switch.

6. The scan driving circuit of claim 1, wherein the pull-down maintaining assembly further comprises a second pull-down maintaining assembly; the second pull-down maintaining assembly comprises a second pull-down maintaining unit and a second pull-down maintaining control unit that drives the second pull-down maintaining unit; the pull-down maintaining signal further comprises a second pull-down maintaining signal, logical operation of the first pull-down maintaining signal is opposite to logical operation of the second pull-down maintaining signal; the second pull-down maintaining unit comprises an eighth controllable switch and a ninth controllable switch, the second pull-down maintaining signal is sent to control ends of the eighth controllable switch and the ninth controllable switch through the second pull-down maintaining control unit; the first reference low-level signal is sent to the current scanning line through the eighth controllable switch, and the second reference low-level signal is sent to an output end of the pull-up control assembly through the ninth controllable switch;

when the current scanning line is inactive, the eighth controllable switch and the ninth controllable switch turn on according to the first pull-down maintaining signal and the second pull-down maintaining signal, the eighth controllable switch controls the first reference low-level signal to be sent to the current scanning line, and the ninth controllable switch controls the second reference low-level signal to be sent to the output end of the pull-up control assembly;

when the current scanning line is active, the eighth controllable switch and the flint h controllable switch turn off, the eighth controllable switch controls the first reference low-level signal not to be sent to the current scanning line, and the ninth controllable switch controls the second reference low-level signal not to be sent to the output end of the pull-up control assembly.

7. The scan driving circuit of claim 6, wherein the second pull-down maintaining control unit comprises a tenth controllable switch, an eleventh controllable switch, and a twelfth controllable switch; the tenth controllable switch uses a diode connection method; in the diode connection method, the second pull-down maintaining signal is sent to an input end and a control end of the tenth controllable switch, an output end of the tenth controllable switch is coupled to a control end of the eleventh controllable switch, and the second pull-down maintaining signal is sent to an input end of the eleventh controllable switch; the first pull-down maintaining signal is sent to a control end of the twelfth controllable switch, the second pull-down maintaining signal is sent to an input end of the twelfth controllable switch, and output ends of the eleventh controllable switch and the twelfth controllable switch are coupled to the control ends of the eighth controllable switch and the ninth controllable switch;

when the current scanning line is inactive, the eighth controllable switch and the ninth controllable switch turn on according to the first pull-down maintaining signal and the second pull-down maintaining signal, the first reference low-level signal reduces electric potential of the current scanning line through the eighth controllable switch, and the second reference low-level signal reduces electric potential of the output end of the pull-up control assembly through the ninth controllable switch;

when the current scanning line is active, the eighth controllable switch and the ninth controllable switch turn off, which prevents the first reference low-level signal from being sent to the current scanning line, and the second reference low-level signal from being sent to the output end of the pull-up control assembly.

8. The scan driving circuit of claim 7, wherein the second pull-down maintaining unit further comprises a turn-off unit, the turn-off unit further comprises a thirteenth controllable switch; a control end of the thirteenth controllable switch is coupled to the output end of the pull-up control assembly, an input end of the thirteenth controllable switch is coupled to the control end of the eleventh controllable switch, and the first reference low-level signal or the second reference low-level signal is sent to an output end of the thirteenth controllable switch.

9. The scan driving circuit of claim 8, wherein the pull-down maintaining assembly further comprises a diverter switch, a control end of the diverter switch is coupled to the output end of the pull-up control assembly the diverter switch is arranged between the control ends of the first controllable switch and the second controllable switch and the control ends of the eighth controllable switch and the ninth controllable switch:

when the current scanning line is active, the diverter switch turns on and controls the control end of the first pull-down maintaining unit to be connected to the control end of the second pull-down maintaining unit; electric potential of one of the control ends of the first pull-down maintaining unit and the second pull-down maintaining unit, that is at high level, is reduced by electric potential of another control end that is at low level, which turns off the first pull-down maintaining unit and the second pull-down maintaining unit.

10. The scan driving circuit of claim 6, wherein the pull-up control assembly comprises a seventeenth controllable switch; an output end of the seventeenth controllable switch is coupled to the control end of the pull-up assembly, a pull-up control signal is sent to a control end and an input end of the seventeenth controllable switch; the pull-up assembly comprises an eighteenth controllable switch, a control end of the eighteenth controllable switch is coupled to the output end of the seventeenth controllable switch, the clock scanning signal is sent to an input end of the eighteenth controllable switch, and an output end of the eighteenth controllable switch is coupled to the current scanning line; the scan driving circuit further comprises a storage capacitor, a first end of the storage capacitor is coupled to the output end of the pull-up control assembly, and a second end of the storage capacitor is coupled to the output end of the pull-up assembly.

11. The scan driving circuit of claim 1, wherein the pull-up control assembly comprises a seventeenth controllable switch; an output end of the seventeenth controllable switch is coupled to the control end of the pull-up assembly, a pull-up control signal is sent to a control end and an input end of the seventeenth controllable switch; the pull-up assembly comprises an eighteenth controllable switch, a control end of the eighteenth controllable switch is coupled to the output end of the seventeenth controllable switch, a clock scanning signal is sent to an input end of the eighteenth controllable switch, and an output end of the eighteenth controllable switch is coupled to the current scanning line; the scan driving circuit further comprises a storage capacitor, a first end of the storage capacitor is coupled to the output end of the pull-up control assembly, and a second end of the storage capacitor is coupled to the output end of the pull-up assembly.

12. The scan driving circuit of claim 1, wherein the pull-up control assembly comprises a seventeenth controllable switch; an output end of the seventeenth controllable switch is coupled to the control end of the pull-up assembly, a pull-up control signal is sent to a control end and an input end of the seventeenth controllable switch; the pull-up assembly comprises an eighteenth controllable switch, a control end of the eighteenth controllable switch is coupled to the output end of the seventeenth controllable switch, the clock scanning signal is sent to an input end of the eighteenth controllable switch, and an output end of the eighteenth controllable switch is coupled to the current scanning line; the scan driving circuit further comprises a storage capacitor, a first end of the storage capacitor is coupled to the output end of the pull-up control assembly, and a second end of the storage capacitor is coupled to the output end of the pull-up assembly.

13. A liquid crystal display (LCD) device, comprising:

a scan driving circuit comprising a pull-up assembly, a pull-up control assembly that drives the pull-up assembly, a pull-down maintaining assembly, and a reference low-level signal;

wherein the reference low-level signal comprises a first reference low-level signal and a second reference low-level signal; an output end of the pull-up assembly is coupled to a current scanning line, an output end of the pull-up control assembly is connected to a control end of the pull-up assembly, electric potential of the second reference low-level signal is lower than electric potential of the first reference low-level signal;

when the current scanning line is inactive, the second reference low-level signal is sent to the output end of the pull-up control assembly through the pull-down maintaining assembly, and the first reference low-level signal is also sent to the current scanning line through the pull-down maintaining assembly;

wherein the pull-down maintaining assembly comprises a first pull-down maintaining assembly, the first pull-down maintaining assembly comprises a first pull-down maintaining unit and a first pull-down maintaining control unit that drives the first pull-down maintaining unit; the first pull-down maintaining unit comprises a first controllable switch and a second controllable switch, the pull-down maintaining signal comprises a first pull-down maintaining signal, wherein the first pull-down maintaining signal is sent to control ends of the first controllable switch and the second controllable switch through the first pull-down maintaining control unit; the second reference low-level signal is sent to the output end of the pull-up control assembly through the second controllable switch, and the first reference low-level signal is sent to the current scanning line through the first controllable switch; electric potential of the pull-down maintaining signal, that is at a low level, is less than electric potential of the second reference low-level signal;

when the current scanning line is inactive, the first pull-down maintaining control unit controls the first controllable switch and the second controllable switch to turn on according to the first pull-down maintaining signal, the first controllable switch controls the second reference low-level signal to be sent to the output end of the pull-up control assembly, and the second controllable switch controls the first reference low-level signal to be sent to the current scanning line;

when the current scanning line is active, the first controllable switch and the second controllable switch turn off, the first controllable switch controls the second reference low-level signal not to be sent to the output end of the pull-up control assembly, and the second controllable switch controls the first reference low-level signal not to be sent to the current scanning line.

14. The LCD device of claim 13, wherein the pull-down maintaining assembly comprises a first pull-down maintaining assembly, a second pull-down maintaining assembly and a pull-down maintaining signal; input ends of the first pull-down maintaining assembly and the second pull-down maintaining assembly are coupled to the output end of the pull-up control assembly, the pull-down maintaining signal is sent to control ends of the first pull-down maintaining assembly and the second pull-down maintaining assembly, and the reference low-level signal is sent to output ends of the first pull-down maintaining assembly and the second pull-down maintaining assembly;

the scan driving circuit further comprises a diverter switch, the diverter switch is connected between the control end of the first pull-down maintaining assembly and the control end of the second pull-down maintaining assembly, a control end of the diverter switch is coupled to the output end of the pull-up control assembly;

when the current scanning line is active, a second controllable switch turns off the first pull-down maintaining assembly and the second pull-down maintaining assembly, causing the reference low-level signal not to be sent to the output end of the pull-up control assembly and the current scanning line.

15. The LCD device of claim 13, wherein the pull-down maintaining signal comprises a second pull-down maintaining signal, logical operation of the first pull-down maintaining signal is opposite to logical operation of the second pull-down maintaining signal; the first pull-down maintaining control unit comprises a third controllable switch, a fourth controllable switch, and a fifth controllable switch: the third controllable switch uses a diode connection method; in the diode connection method, the first pull-down maintaining signal is sent to an input end and a control end of the third controllable switch, an output end of the third controllable switch is coupled to a control end of the fourth controllable switch and the first pull-down maintaining signal is sent to an input end of the fourth controllable switch; the second pull-down maintaining signal is sent to a control end of the fifth controllable switch, the first pull-down maintaining signal is sent to an input end of the fifth controllable switch, and output ends of the fourth controllable switch and the fifth controllable switch are coupled to the control ends of the first controllable switch and the second controllable switch;

when the current scanning line is inactive, the first controllable switch and the second controllable switch turn on according to the first pull-down maintaining signal and the second pull-down maintaining signal; the first reference low-level signal reduces electric potential of the current scanning line through the first controllable switch, and the second reference low-level signal reduces electric potential of the output end of the pull-up control assembly through the second controllable switch;

when the current scanning line is active, the first controllable switch and the second controllable switch turn off, the second reference low-level signal is not sent to the output end of the pull-up control assembly, and the first reference low-level signal is not sent to the current scanning line;

the pull-down maintaining assembly comprises a turn-off unit, the turn-off unit comprises a sixth controllable switch, a control end of the Sixth controllable switch is coupled to the output end of the pull-up control assembly, and an input end of the sixth controllable switch is coupled to the control end of the fourth controllable switch; the first reference low-level signal, the second reference low-level signal, or the second pull-down maintaining signal is sent to an output end of the sixth controllable switch.

16. The LCD device of claim 13, wherein the pull-down maintaining assembly further comprises a second pull-down maintaining assembly; the second pull-down maintaining assembly comprises a second pull-down maintaining unit and a second pull-down maintaining control unit that drives the second pull-down maintaining unit; the pull-down maintaining signal further comprises a second pull-down maintaining signal, logical operation of the first pull-down maintaining signal is opposite to logical operation of the second pull-down maintaining signal; the second pull-down maintaining unit comprises an eighth controllable switch and a ninth controllable switch, the second pull-down maintaining signal is sent to control ends of the eighth controllable switch and the ninth controllable switch through the second pull-down maintaining control unit; the first reference low-level signal is sent to the current scanning line through the eighth controllable switch, and the second reference low-level signal is sent to an output end of the pull-up control assembly through the ninth controllable switch;

when the current scanning line is inactive, the eighth controllable switch and the ninth controllable switch turn on according to the first pull-down maintaining signal and the second pull-down maintaining signal, the eighth controllable switch controls the first reference low-level signal to be sent to the current scanning line, and the ninth controllable switch controls the second reference low-level signal to be sent to the output end of the pull-up control assembly;

when the current scanning line is active, the eighth controllable switch and the ninth controllable switch turn off, the eighth controllable switch controls the first reference low-level signal not to be sent to the current scanning line, and the ninth controllable switch controls the second reference low-level signal not to be sent to the output end of the pull-up control assembly.

17. The LCD device of claim 16, wherein, wherein the second pull-down maintaining control unit comprises a tenth controllable switch, an eleventh controllable switch, and a twelfth controllable switch; the tenth controllable switch uses a diode connection method; in the diode connection method, the second pull-down maintaining signal is sent to an input end and a control end of the tenth controllable switch, an output end of the tenth controllable switch is coupled to a control end of the eleventh controllable switch, and the second pull-down maintaining signal is sent to an input end of the eleventh controllable switch; the first pull-down maintaining signal is sent to a control end of the twelfth controllable switch, the second pull-down maintaining signal is sent to an input end of the twelfth controllable switch, and output ends of the eleventh controllable switch and the twelfth controllable switch are coupled to the control ends of the eighth controllable switch and the ninth controllable switch;

when the current scanning line is inactive, the eighth controllable switch and the ninth controllable switch turn on according to the first pull-down maintaining signal and the second pull-down maintaining signal, the first reference low-level signal reduces electric potential of the current scanning line through the eighth controllable switch, and the second reference low-level signal reduces electric potential of the output end of the pull-up control assembly through the ninth controllable switch;

when the current scanning line is active, the eighth controllable switch and the ninth controllable switch turn off, which prevents the first reference low-level signal from being sent to the current scanning line, and the second reference low-level signal from being sent to the output end of the pull-up control assembly;

the second pull-down maintaining unit thither comprises a turn-off unit, the turn-off unit further comprises a thirteenth controllable switch; a control end of the thirteenth controllable switch is coupled to the output end of the pull-up control assembly, an input end of the thirteenth controllable switch is coupled to the control end of the eleventh controllable switch, and the first reference low-level signal or the second reference low-level signal is sent to an output end of the thirteenth controllable switch;

the pull-down maintaining assembly further comprises a diverter switch, a control end of the diverter switch is coupled to the output end of the pull-up control assembly, the diverter switch is arranged between the control ends of the first controllable switch and the second controllable switch and the control ends of the eighth controllable switch and the ninth controllable switch;

when the current scanning line, is active, the diverter switch turns on and controls the control end of the first pull-down maintaining unit to be connected to the control end of the second pull-down maintaining unit; electric potential of one of the control ends of the first pull-down maintaining unit and the second pull-down maintaining unit, that is at high level, is reduced by electric potential of another control end that is at low level, which turns off the first pull-down maintaining unit and the second pull-down maintaining unit.

18. The LCD device of claim 13, wherein the pull-up control assembly comprises a seventeenth controllable switch; an output end of the seventeenth controllable switch is coupled to the control end of the pull-up assembly, a pull-up control signal comprises the is sent to a control end and an input end of the seventeenth controllable switch; the pull-up assembly comprises an eighteenth controllable switch, a control end of the eighteenth controllable switch is coupled to the output end of the seventeenth controllable switch, a clock scanning signal is sent to an input end of the eighteenth controllable switch, and an output end of the eighteenth controllable switch is coupled to the current scanning line; the scan driving circuit further comprises a storage capacitor, a first end of the storage capacitor is coupled to the output end of the pull-up control assembly, and a second end of the storage capacitor is coupled to the output end of the pull-up assembly.

19. A scan driving circuit, comprising:

a pull-up assembly;

a pull-up control assembly that drives the pull-up assembly;

a pull-down maintaining assembly; and a reference low-level signal comprising a first reference low-level signal and a second reference low-level signal;

wherein an output end of the pull-up assembly is coupled to a current scanning line, an output end of the pull-up control assembly is connected to a control end of the pull-up assembly, electric potential of the second reference low-level signal is less than electric potential of the first reference low-level signal;

when the current scanning line is inactive, the second reference low-level signal is sent to the output end of the pull-up control assembly through the pull-down maintaining assembly, and the first reference low-level signal is also sent to the current scanning line through the pull-down maintaining assembly;

wherein the pull-down maintaining assembly comprises a first pull-down maintaining assembly, a second pull-down maintaining assembly, and a pull-down maintaining signal; input ends of the first pull-down maintaining assembly and the second pull-down maintaining assembly are coupled to the output end of the pull-up control assembly, the pull-down maintaining signal is sent to control ends of the first pull-down maintaining assembly and the second pull-down maintaining assembly, and the reference low-level signal is sent to output ends of the first pull-down maintaining assembly and the second pull-down maintaining assembly;

wherein the scan driving circuit further comprises a diverter switch, the diverter switch is connected between the control end of the first pull-down maintaining assembly and the control end of the second pull-down maintaining assembly a control end of the diverter switch is coupled to the output end of the pull-up control assembly;

when the current scanning line is active, a second controllable switch turns off the first pull-down maintaining assembly and the second pull-down maintaining assembly, causing the reference low-level signal not to be sent to the output end of the pull-up control assembly and the current scanning line.

* * * * *